US006497274B2

(12) United States Patent
Cheadle

(10) Patent No.: US 6,497,274 B2
(45) Date of Patent: Dec. 24, 2002

(54) HEAT EXCHANGER WITH PARALLEL FLOWING FLUIDS

(75) Inventor: Brian Cheadle, Bramalea (CA)

(73) Assignee: Long Manufacturing Ltd., Ontario (CA)

( * ) Notice: Subject to any disclaimer, the term of this patent is extended or adjusted under 35 U.S.C. 154(b) by 8 days.

(21) Appl. No.: 09/750,646

(22) Filed: Dec. 28, 2000

(65) Prior Publication Data

US 2002/0000310 A1 Jan. 3, 2002

(30) Foreign Application Priority Data

Jun. 23, 2000 (CA) ..... 2312113

(51) Int. Cl.[7] ..... F28F 3/04

(52) U.S. Cl. ..... 165/167; 165/916; 123/196 AB

(58) Field of Search ..... 165/167, 916; 123/196 AB

(56) References Cited

U.S. PATENT DOCUMENTS

| | | | | |
|---|---|---|---|---|
| 3,743,011 A | | 7/1973 | Frost | |
| 3,762,467 A | | 10/1973 | Poon et al. | |
| 3,887,467 A | | 6/1975 | Johnson | |
| 4,058,980 A | * | 11/1977 | Ahlen | 165/916 |
| 4,271,901 A | | 6/1981 | Buchmuller | |
| 4,561,494 A | | 12/1985 | Frost | |
| 4,638,856 A | | 1/1987 | Yamanaka et al. | |
| 4,662,435 A | | 5/1987 | Bohlin | |
| 4,669,532 A | * | 6/1987 | Tejima et al. | 165/167 |
| 4,708,199 A | * | 11/1987 | Yogo et al. | 165/167 |
| 4,742,866 A | | 5/1988 | Yamanaka et al. | |
| 4,878,536 A | | 11/1989 | Stenlund | |
| 4,892,136 A | | 1/1990 | Ichihara et al. | |
| 4,967,835 A | | 11/1990 | Lefeber | |
| 5,014,775 A | | 5/1991 | Watanabe | |
| 5,078,209 A | | 1/1992 | Kerkman et al. | |
| 5,179,999 A | | 1/1993 | Meekins et al. | |
| 5,203,832 A | | 4/1993 | Beatenbough et al. | |
| 5,343,936 A | | 9/1994 | Beatenbough et al. | |
| 5,406,910 A | | 4/1995 | Wallin | |
| 5,464,056 A | * | 11/1995 | Tajima et al. | 123/196 AB |
| 5,797,450 A | | 8/1998 | Kawabe et al. | |
| 5,931,219 A | | 8/1999 | Kull et al. | |
| 6,085,832 A | | 7/2000 | Rehberg | |
| 6,170,568 B1 | * | 1/2001 | Valenzuela | 165/167 |

FOREIGN PATENT DOCUMENTS

| | | |
|---|---|---|
| JP | 63-23579 | 2/1988 |
| JP | 4-356686 | 12/1992 |
| JP | 6-173626 | 6/1994 |
| WO | WO 98/44305 A | 10/1998 |

OTHER PUBLICATIONS

Pamphlet, "Innovative Olfiltersysteme mit Olabscheider", System Partners 98, pp. 88–92, date unknown.

* cited by examiner

*Primary Examiner*—Leonard Leo
(74) *Attorney, Agent, or Firm*—Dykema Gossett PLLC

(57) ABSTRACT

A heat exchanger having a plurality of stacked plate pairs consisting of face-to-face mating plates with each plate having a peripheral flange and annular inner and outer primary bosses. Each boss has a portion thereof located in a common first plane with the peripheral flange. An annular secondary boss has a portion thereof located in a second plane spaced from the first plane. Intermediate areas between the inner and outer primary bosses have spaced-apart portions to form inner flow passages. Both the primary and secondary bosses have openings formed therein for the passage of heat exchanging fluids. In back-to-back plate pairs, the secondary bosses are joined and the openings therein communicate to define a manifold for a second of these fluids. The inner and outer primary bosses include radially extending ribs formed about the circumference of each boss and extending substantially across the boss. These ribs are located between the openings formed in the boss and form cross-over passages that permit the second fluid to flow across the primary bosses and through the inner flow passage. There are also rectangular versions of the heat exchanger having at least first and second elongate primary ridges and at least one elongate secondary ridge.

48 Claims, 16 Drawing Sheets

HEAT EXCHANGER WITH PARALLEL FLOWING FLUIDS

BACKGROUND OF THE INVENTION

This invention relates to heat exchangers, including oil coolers of the so-called "doughnut" type that can be used separately or in conjunction with oil filters in automotive and other engine and transmission cooling applications and heat exchangers or oil coolers having a rectangular shape. This invention also relates to manifolds for the transfer and distribution of two fluids, particularly heat exchanging fluids.

Oil coolers have been made in the past out of a plurality of stacked plate pairs located in a housing or canister. The canister usually has inlet and outlet fittings for the flow of engine coolant into and out of the canister circulating around the plate pairs. The plate pairs themselves have inlet and outlet openings and these openings are usually aligned to form manifolds, so that the oil passes through all of the plate pairs simultaneously. These manifolds communicate with oil supply and return lines located externally of the canister. An example of such an oil cooler is shown in Japanese Utility Model Laid Open Publication No. 63-23579 published Feb. 16, 1988.

Where the oil cooler is used in conjunction with an oil filter, the plate pairs are usually in the form of an annulus and a conduit passes through the center of the annulus delivering oil to or from the filter located above or below the oil cooler and connected to the conduit. The oil can pass through the filter and then the oil cooler, or vice-versa. Examples of such oil coolers are shown in U.S. Pat. Nos. 4,967,835 issued to Thomas E. Lefeber and 5,406,910 issued to Charles M. Wallin.

A difficulty with these prior art heat exchangers (HXs) however is that they have limited performance efficiency. This limitation is exacerbated in applications where compact HX configurations are required. In particular, in prior art HXs at least one of the fluids must be circulated through the stack plate passages in a circumferential, or split-flow circumferential flow direction. This results in a high flow resistance, or pressure drop for this fluid. Also, the necessity to include relatively large fluid ports within prime regions of the plate area that could otherwise be used for heat transfer, detracts from overall performance or compactness. Thirdly, there are inherent flow distribution problems with one or all of the fluids being distributed around, or between the plate heat transfer passages, which are difficult to overcome in prior art designs. Finally, to maximize heat transfer efficiency it is desirable to achieve a true counter-flow direction between the two fluids, yet this is impractical in prior art constructions. In these cases, the two fluids flow at essentially perpendicular directions.

The present invention provides a high performance compact heat exchanger in which the two fluids can have a true parallel flow direction including counterflow direction and yet low pressure drop. Further the HXs described herein can achieve extremely uniform flow distribution according to the flow conditions required, and a graduation means to control this in changing section, or irregular shaped HXs. There is also provided a novel manifold that allows flexibility in locating external fluid connections, while providing a low pressure drop and balanced flow distribution interface with the HX internal fluid distribution manifolds.

The present invention is expected to have particular applicability to compact automotive heat exchangers, including oil/water transmission and engine oil heat exchangers and other high performance liquid to liquid or liquid to gas heat exchangers. The present invention offers particular benefits for refrigerant to water (or other liquid) HX's in as much as two phase fluids are normally particularly sensitive to flow maldistribution effects, both within the heat exchange passages and the connection manifolds, and which the present invention overcomes.

More specifically, a preferred embodiment of the present invention is a high performance, plate type compact HX based on structural provision of cross-over passages that intersect internal fluid distribution manifolds. These cross-over passages allow both fluids to be directed in a short path, counterflow relationship. A low pressure drop is simultaneously achieved for both fluids, based on the resultant short paths, and by judicious selection of appropriate heat transfer augmentation means.

In one preferred version of the invention, there is a deliberate adjustment of the size and shape of fluid transfer apertures that are arranged in groupings to allow parallel flow distribution, the adjustment being used to achieve uniform flow distribution across the plate surfaces, and over a range of HX shapes.

A preferred embodiment of the present invention is a heat exchanger having a self-enclosing configuration, ie without the need for an external housing to contain one of the fluids. If desired, the invention can still be used in a form having an external "can" or housing that contains the heat exchanger.

Optional design features of these HXs are also described that include a fluid passage to allow partial bypassing of one fluid, in the case that an excess flow supply needs to be accommodated, and internal cones to improve flow distribution.

The heat exchanger of the present invention is very efficient with relatively low pressure drop. In one version of the present heat exchanger employing mating ringlike plates which are placed in a stack, the two heat exchanging fluids are able to travel radially so the two fluid flows are parallel to one another. Thus, the first heat exchanging fluid can flow radially through inner flow passages formed between the plates while a second heat exchanging fluid is able to flow through outer flow passages formed between back-to-back plate pairs. In another version of the heat exchanger of the invention which can employ generally rectangular plates, again, the two heat exchanging fluids are able to flow in inner and outer flow passages in parallel directions.

In one version of the invention employing ringlike or annular plates and annular primary and secondary bosses, radially extending ribs are formed about the circumference of one or more of the primary bosses and extend substantially across their respective boss. These ribs are located between and separated from openings formed in their respective primary bosses and they form cross-over passages that permit one of the heat exchange fluids to flow radially across the primary bosses and through inner flow passages. In a rectangular embodiment of the heat exchanger, each plate in the stack is formed with first and second elongate primary ridges and at least one secondary ridge and at least a portion of the primary ridges have ribs extending transversely across the width of the ridge and distributed along the length thereof. Again, these ribs are located between and separated from openings formed in the primary ridges and form cross-over passages that permit one of the heat exchanging fluids to flow transversely across the primary ridges and through inner flow passages.

SUMMARY OF THE INVENTION

According to one aspect of the invention, a heat exchanger comprises an plurality of stack plate pairs consisting of face-to-face, mating ringlike plates, each plate having a peripheral flange and annular inner and outer primary bosses each having a portion thereof located in a common first plane with the peripheral flange. Each plate also has an annular secondary boss having a portion thereof located in a second plane spaced from the first plane and parallel thereto. Intermediate areas are located between the inner and outer primary bosses and the peripheral flanges and the primary bosses in the mating plates are joined together. The intermediate areas of each plate pair have spaced-apart portions to form an inner flow passage between the plates. The secondary boss is located adjacent to one of the primary bosses and on a side thereof furthest from the other of the primary bosses. Both the primary bosses and the secondary bosses have openings formed therein for passage of first and second heat exchanging fluids respectively. The secondary bosses are arranged such that in back-to-back plate pairs, the secondary bosses are joined and the respective openings therein communicate to define a manifold for the flow of the second heat exchanging fluid. The intermediate areas of back-to-back plate pairs define outer flow passages therebetween. The primary bosses of at least one plate of each pair include radially extending ribs formed about the circumferences of at least one primary boss and extending substantially across the respective primary boss. These ribs are located between and separated from the openings formed in the primary boss and form cross-over passages so that the cross-over passages of each plate pair permit the secondary heat exchange fluid to flow across its respective primary bosses and through its respective inner flow passage.

In the preferred version of this heat exchanger, the peripheral flange is an outer peripheral flange located radially outward from the primary and secondary bosses and the secondary boss is an outer secondary boss located radially outwards from its respective outer primary boss. There are also flow augmentation means preferably located in both of the inner flow passages and the outer flow passages.

According to another aspect of the invention, a heat exchanger for heat transfer between first and second heat exchanging fluids includes a plurality of stacked plate pairs consisting of face-to-face mating plates, each plate having edge flanges extending along edges thereof and first and second spaced-apart elongate primary ridges each having a portion thereof located in a common first plane with the at least one of the edge flanges. Each plate also has an elongate secondary ridge having a portion thereof located in a second plane spaced from the first plane and substantially parallel thereto. The secondary ridge is provided between an adjacent one of the edge flanges and the first primary ridge of the respective plate. An intermediate area is located between the first and second primary ridges and these areas of each pair have spaced-apart portions to form an inner flow passage between the plates. Both the primary ridges and the secondary ridge have openings formed therein for the passage of the first and second heat exchanging fluids respectively. The secondary ridges are arranged such that in back-to-back plate pairs, the secondary ridges are joined and the respective openings therein communicate to define a manifold for the flow of the second heat exchanging fluid. The intermediate areas of back-to-back plate pairs have spaced-apart portions defining outer flow passages therebetween. The primary ridges of at least one plate of each pair include ribs extending across the width of at least one primary ridge of the at least one plate and distributed along the length of the primary ridge. These ribs are located between and separated from the openings formed in the primary ridge and form cross-over passages so that the cross-over passages of each plate pair permit the secondary heat exchanging fluid to flow transversely across its respective primary ridges and through its respective inner flow passage.

Again, this heat exchanger preferably includes flow augmentation means located in both of the inner flow passages and the outer flow passages.

According to still another aspect of this invention, there is provided a manifold for the transfer and distribution of two fluids (such as two heat exchanging fluids) which may be used in conjunction with the aforementioned heat exchanger which employs mating ringlike plates. This manifold comprises a pair of manifold plates consisting of face-to-face, mating ringlike plates each having inner and outer peripheral flanges and substantially annular inner and outer bosses projecting in the same direction from a first plane defined by the outer peripheral flange. Each plate also includes a substantially annular intermediate channel located between the inner and outer bosses and having openings for passage of a first fluid between the two intermediate channels. At least one of the intermediate channels has radial ribs formed about the circumference of the channel and extending substantially across the channel. These ribs are formed between and separated from the openings formed in the channel and form cross-over passages that permit a second fluid to flow in a radial direction between the inner and outer bosses. At least one of the outer bosses has at least one port formed for the passage of the second fluid into or out of a sealed first space formed between the two outer bosses. There are also means extending over one side of the pair of manifold plates for sealingly enclosing the adjacent intermediate channel of the manifold plates. This enclosing device has one or more apertures formed therein and forms a flow passage for the fluid to flow between the openings in the intermediate channels and the one or more apertures. The inner boss of one of the pair of manifold plates has holes for the passage of the second fluid into or out of a sealed second space formed by the two inner bosses.

In the preferred manifold, the enclosing device is a third plate and the first and second fluids are heat exchanging fluids for carrying out heat exchange in a heat exchanger.

Preferred embodiments of the invention will now be described, by way of example, with reference to the accompanying drawings.

DETAILED DESCRIPTION OF PREFERRED EMBODIMENTS

Figure 1:
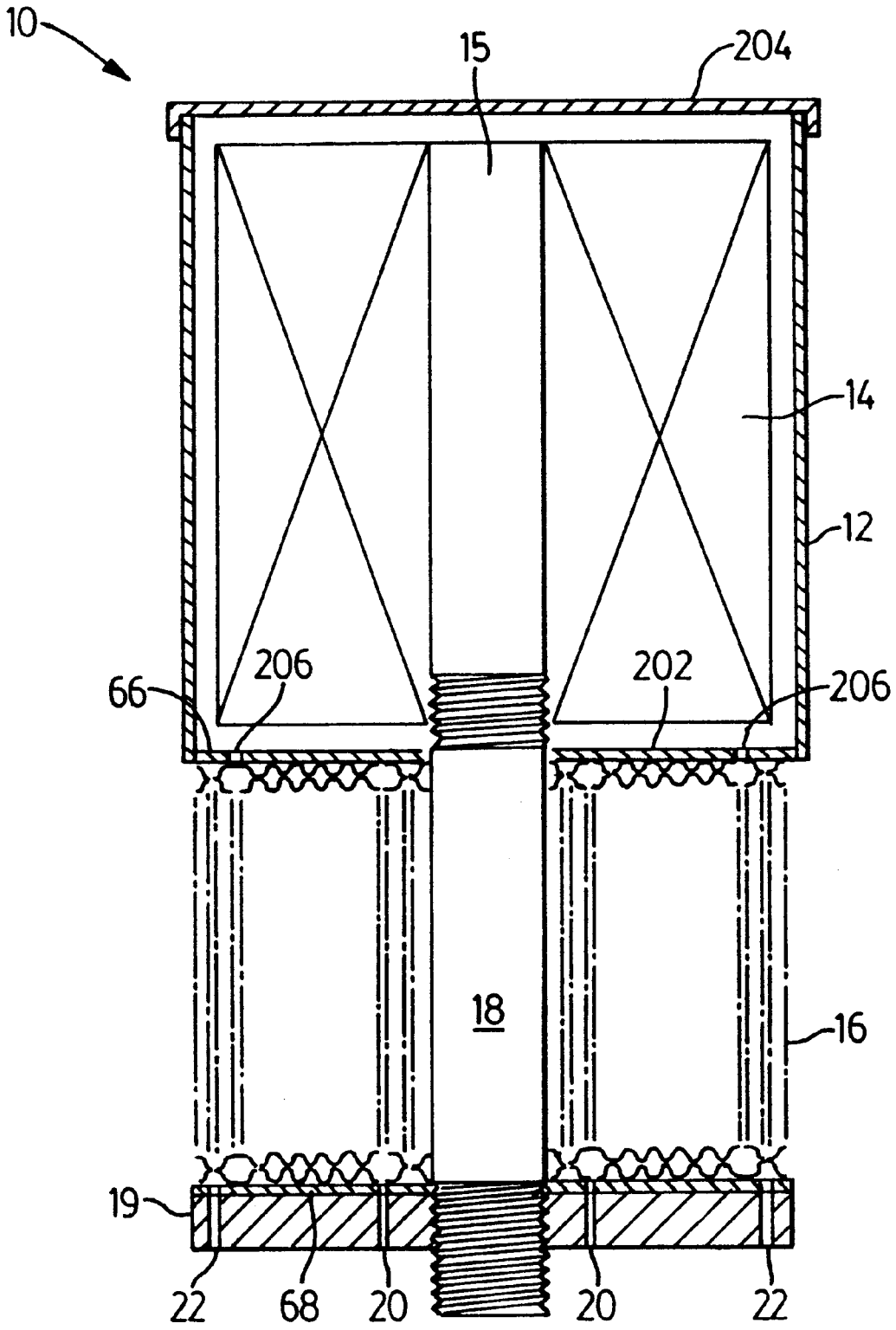
FIG. 1 is a diagrammatic vertical sectional view taken through a preferred embodiment of a combination heat exchanger and oil filter employing a heat exchanger according to the present invention.

With reference to FIG. 1, a preferred embodiment of a combination heat exchanger and oil filter according to the present invention is generally indicated by reference numeral 10, but it will be appreciated however, that any fluid could be used in this invention, not just oil, so the term "oil" shall mean any heat exchange fluid for the purposes of this description. The combination unit 10 includes a housing 12 containing an oil filter 14 and a preferred embodiment of a heat exchanger according to the present invention indicated by reference numeral 16. The oil filter 14 can be conventional and is not per se considered to be part of the present invention. The oil filter 14 is of the annular type and, in the embodiment of FIG. 1, oil flows from inside the housing inwardly through the filter walls to a central axial chamber 15 and passes downwardly through a pipe or conduit 18 to exit from the combination unit 10. It will be understood that the oil flow direction can be reversed, if desired, so that oil enters through the conduit 18 and passes outwardly through the filter into the housing 12. The heat exchanger has a top closure plate 202 that also forms the bottom of the housing 12. A removable lid 204 allows for the replacement of the filter 14. The illustrated heat exchanger has a bottom plate 19 containing suitable openings 20 therein for the passage of oil therethrough into or out of the heat exchanger 16, the precise location of these openings depending upon which way the manufacturer desires to have the oil flow through the filter 14 and the heat exchanger. The oil can enter or exit through the top plate 202 by passages 206 formed in this plate. Conduits 22 can be provided through the bottom plate 19 for the entry of coolant, for example, water, into and out of the heat exchanger 16. Although the illustrated housing 12 does not contain the heat exchanger, it is quite possible to extend the housing downwards to enclose the heat exchanger 16. This might be done, for example, for an improved appearance of the combination or where the heat exchanger does not have an internal outer manifold for the coolant (as explained further hereinafter).

Referring next to FIGS. 2 to 5, the heat exchanger 16 is formed of a plurality of stacked plate pairs 30 consisting of face-to-face, mating, annular or ringlike plates 32. As seen as in these particular figures, each plate 32 preferably has an outer peripheral flange 34 and an inner peripheral flange 35 and annular inner and outer primary bosses 36 and 38 each having a preferably flat portion (indicated at 39) located in a common first plane with the inner and outer peripheral flanges 34 and 35, this first plane being indicated in FIG. 4 by line A. There is an intermediate area 40, which is also annular, and which is located between the inner and outer primary bosses 36 and 38. This intermediate area is located in a plane D that is parallel to and spaced from the plane A. As illustrated, the intermediate areas 40 of each plate pair have spaced-apart portions to form an inner flow passage 42 between the plates. Preferably there are also annular, inner and outer secondary bosses 44 and 46 formed on each plate and each of these secondary bosses has a portion 48 located in a second plane identified by the line B spaced from the first plane at A and the plane D and parallel thereto. It will be particularly noted that the plane B is spaced further from the plane A than the plane D.

Figure 2:
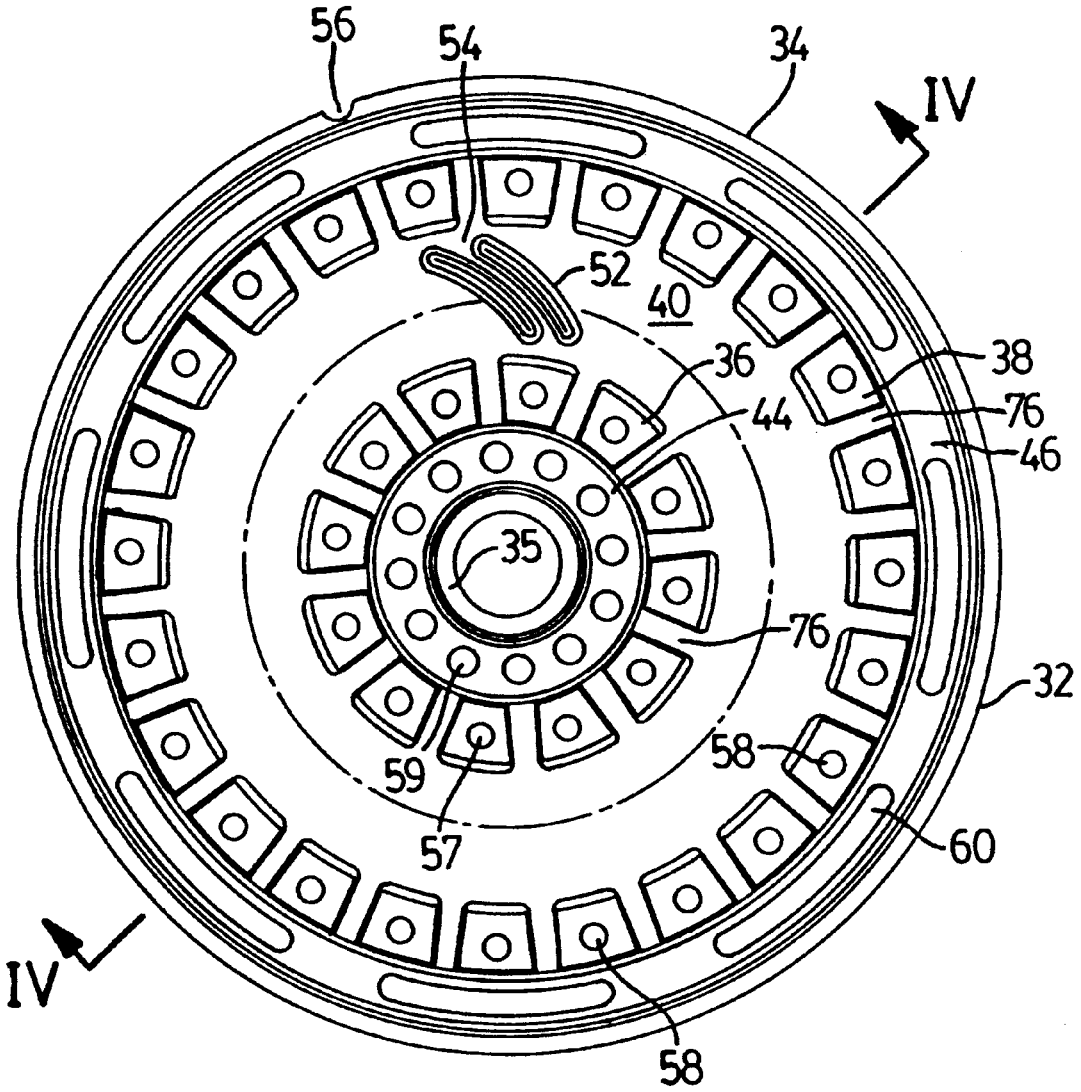
FIG. 2 is a plan view of a ringlike plate used in the heat exchanger used in the combination illustrated in FIG. 1, only two of the curved ribs actually being shown for ease of illustration.

Preferably flow augmentation means or devices are located both in the inner flow passages 42 located between the plates and in outer flow passages 50 which are formed by the intermediate areas 40 of back-to-back plate pairs. One preferred form of flow augmentation means comprises a plurality of alternating ribs and grooves 52 and 54 that are formed in the intermediate areas 40 and extend between the inner and outer primary bosses 36 and 38. The ribs and grooves 52, 54 are angularly disposed which, for purposes of the annular versions of heat exchangers constructed in accordance with the invention, means that the central longitudinal axis of the rib or grooves generally or substantially extends at an acute angle to a radius of the plate or the combined plate pairs that extends across the rib or groove. As illustrated in FIG. 2, in the annular version of the heat exchanger, the ribs and grooves are preferably in the form of spiral or involute curves which results in the ribs and grooves in the respective plates that make up plate pairs 30 forming undulating inner flow passages 42 between the plates of each pair 30. Similarly, the ribs and grooves 52, 54 in adjacent back-to-back plate pairs cross forming undulating outer flow passages 50 between the plate pairs 30. Although generally less preferred, it is also possible to have the flow augmentation means located in only the inner flow passages or in only the outer flow passages. It is also possible for the ribs and grooves in this annular heat exchanger to be straight rather than curved. In the preferred plate of FIGS. 2 and 5, the ribs 52 have height that is equal to the distance between the parallel planes D and B indicated in FIG. 4. In other words, the tops of the ribs 52 are aligned with and lie in the plane B.

As illustrated in FIG. 2, the outer peripheral flanges 34 may optionally be provided with alignment notches 56 to assist in the proper alignment of the plates 32 during the assembly of the heat exchanger 16. Such alignment notches can be used in all of the embodiments of the present invention, if desired.

Figure 4:
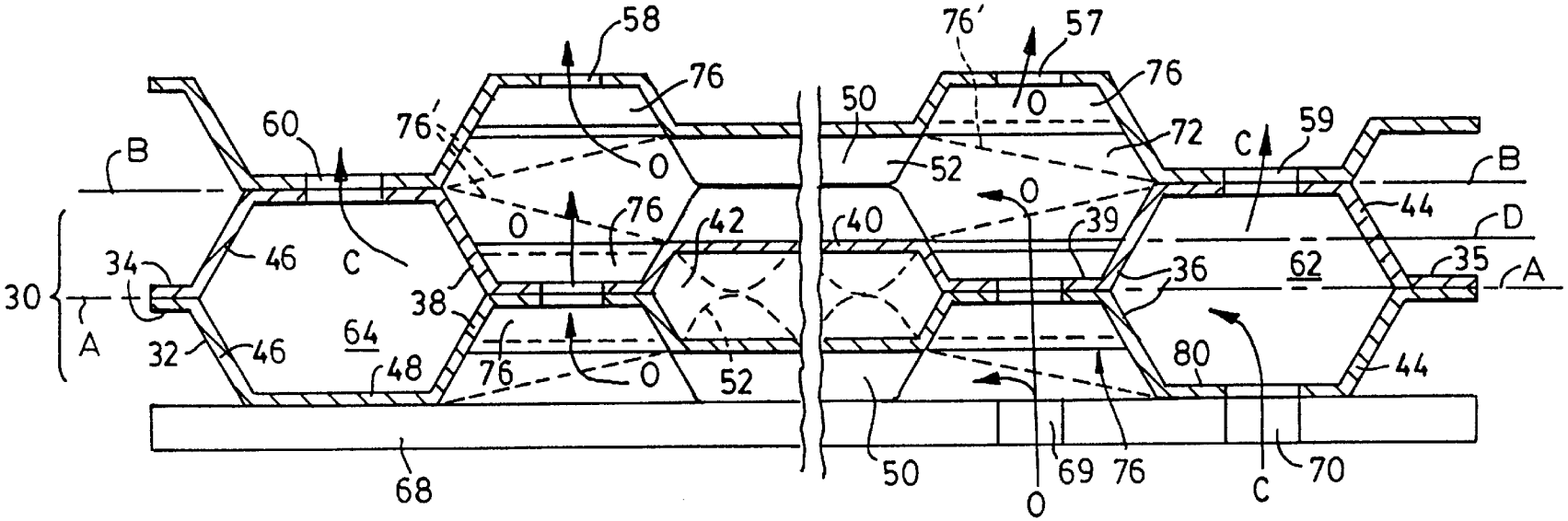
FIG. 4 is an enlarged sectional view taken along line IV—IV of FIG. 2, an intermediate portion being omitted for ease of illustration, and showing two additional plates stacked above and below the plate of FIG. 2.
Figure 5:
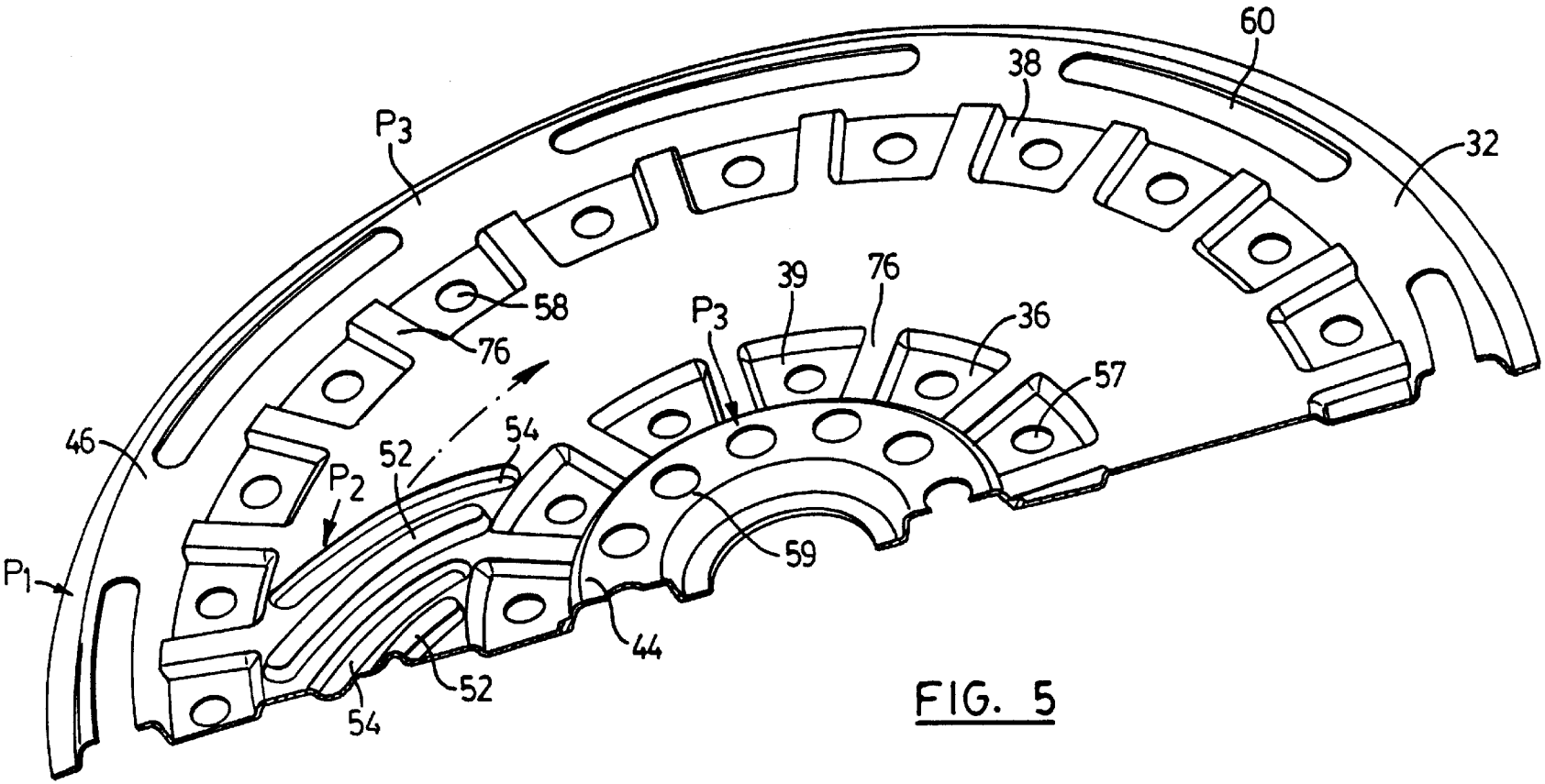
FIG. 5 is an enlarged perspective and axial cross-section showing a portion of one of the plates used to form the heat exchanger shown in FIG. 3, only a portion of a couple of curved ribs being shown on the left side for ease of illustration.

It will be seen that each of the secondary bosses 44 and 46 is located adjacent to one of the primary bosses 36 and 38 and on a side thereof furthest from the other of the primary bosses. In other words, each of the secondary bosses is located on the side of its respective primary boss which is opposite to the intermediate area 40. Both the primary bosses 36 and 38 and the secondary bosses 44 and 46 are formed with a series of spaced-apart openings 57 to 60 formed therein. These openings are for the passage of first and second heat exchanging fluids which can, for example, be engine oil (indicated by the letter O in FIG. 4) and a suitable coolant such as a standard engine coolant or water (indicated by the letter C in FIG. 4). The secondary bosses 44 and 46 are arranged such that in back-to-back plate pairs the secondary bosses are joined, ie. by a brazing process, and their respective openings 59 and 60 communicate to define inner and outer manifolds 62 and 64 for the flow of the second heat exchanging fluid, which in the illustrated embodiment of FIG. 4 is a coolant such as a chemical coolant or water or a combination thereof. The outermost openings 60 can be elongated curved slots, if desired, rather than circular holes.

The illustrated heat exchanger 16 also preferably has top and bottom closure plates or headers 66 and 68 (see FIG. 1). The bottom plate 68 has openings 69 and 70 which register with respective oil inlet manifold 72 (formed by the inner primary bosses 36) and the inner manifold 62 which forms an inlet manifold for the coolant. Suitable conduits (similar to the conduits 20 and 22 illustrated in FIG. 1) can be formed in the bottom plate 19 to communicate with the opening 69 and 70 of the embodiment illustrated in FIG. 4. It will be appreciated that the embodiment shown in FIG. 4 differs from that shown in FIG. 3 and that in the embodiment of FIG. 4, both the coolant C and the oil O flow in the radial outward direction (as explained further hereinafter) from the inner manifolds to the corresponding outer manifolds. However, in the preferred arrangement illustrated in FIG. 3, the coolant enters through the bottom closure plate 68' and into the outer manifold formed by the outer secondary bosses 46 and then flows radially inwardly towards the inner manifold formed by the inner secondary bosses 44. However, the oil in the embodiment of FIG. 3 flows radially outwardly in the opposite direction to that of the coolant (in other words, in a counterflow direction), entering through the bottom closure plate by means of openings (not shown) that are aligned with the holes 57 in the stacked plates. It is generally preferred to have the two fluids flowing in opposite directions to provide for efficient heat exchange rather than flowing in the same radial direction.

The header or bottom closure plate 68 shown in FIG. 4 encloses the inner and outer primary bosses 36 and 38 at one end ie. the bottom end of the stack of plate pairs and this header includes the aforementioned flow port 69 for the flow of the first heat exchange fluid (in the illustrated device, this fluid being oil) therethrough to force this fluid or oil to flow through the outer flow passages 50.

An important aspect of the annular heat exchangers illustrated in FIGS. 1 to 7 is that the inner and outer primary bosses 36, 38 include radially extending ribs 76 preferably formed about the circumference of each primary boss and extending substantially across the respective primary boss. These radial ribs 76 are located between and separated from the openings 57 and 58 formed in the primary bosses. The radial ribs 76 form cross over passages that permit the second heat exchange fluid, for example, the coolant, to flow radially across the primary bosses and through the inner flow passages 42. In other words, the provision of these radial ribs allows the flow of the secondary heat exchanging fluid in a radial direction despite the presence of the two primary bosses 36, 38 between the secondary bosses. The ribs 76 can be formed in only every other plate 32, if desired, but it is preferable to form the ribs 76 in each of the plates 32 of the stack. It is also possible to form the ribs in only one of the primary bosses of each plate provided the matching adjacent plate of the pair has its ribs in the other primary boss. It should also be noted that the ribs 76 and the passages formed thereby should not be excessively high or deep in order not to interfere with the circumferential flow of the heat exchanging fluid in the annular space formed by the primary bosses. In the illustrated preferred embodiment of FIG. 4, the height of the rib 76 is approximately one half of the height of the inner and outer secondary bosses. The ribs can each be of uniform height as illustrated by the solid lines in FIG. 4 or their height can vary from one end of the rib to the opposite end and as illustrated by the dash lines 76' in FIG. 4.

The ribs 52 and the grooves 54 have a predetermined height and the primary bosses 36, 38 have a height that is at least as high as the ribs 52, and preferably the same height as the ribs 52 so that when the plate pairs are placed back-to-back as shown in FIG. 4, the ribs 52 on adjacent plates touch as do the outer surfaces of the primary bosses 36, 38. It is quite possible for the ribs 52 to have a first predetermined height and for the grooves 54 to have a second predetermined height which is different from the first predetermined height. In such case, the inner and outer secondary bosses 44 and 46 each have a height which is equal to the total of the predetermined height of the ribs and the predetermined height of the grooves.

Figure 6:
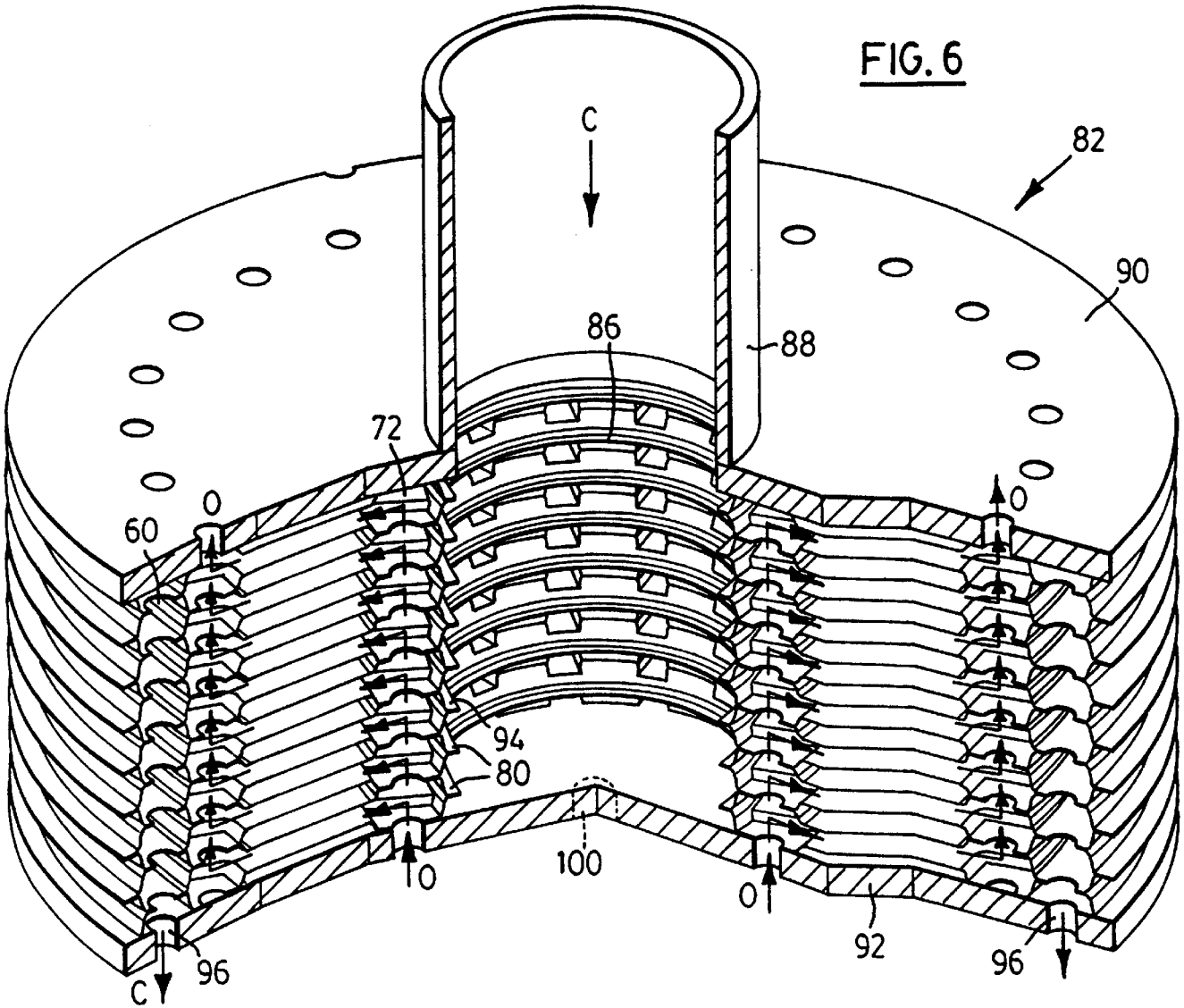
FIG. 6 is an enlarged perspective view, partially broken away, of another embodiment of a heat exchanger constructed in accordance with the invention, this embodiment having a central passage which is closed at the bottom of the heat exchanger.

It will also be appreciated that it is possible to construct an annular heat exchanger in accordance with the present invention so that each of the plates in the stack have only a single annular secondary boss, that is either the inner secondary boss 44 or the outer secondary boss 46. In the version of the heat exchanger having no inner secondary boss 44, each of the plates in the stack can terminate at an inner peripheral flange located at 80 in FIG. 4. This version is illustrated in FIG. 6 of the drawings and is indicated generally by reference 82 with a variation thereof illustrated in FIG. 7 and indicated by reference 84. In the version of FIG. 6, there is a central passage 86 formed by the stack of plates and through which a coolant such as water can pass downwardly from, for example, an attached tube 88 connected to top closure plate 90. In the version of FIG. 6, the bottom of the central passage 86 is closed by the bottom closure plate 92. The coolant is forced to pass radially outwardly through annular slots 94 and, by means of the aforementioned cross-over passages formed by the radial ribs 76, the coolant is able to flow past inner and outer primary bosses and through the inner flow passages and then out through the openings 60 formed in the outer secondary bosses 46. The coolant flows out of the heat exchanger through a number of outlet ports 96 formed in the bottom closure plate 92.

In a variation indicated by the dashed lines in FIG. 6, the bottom closure plate 92 has a central opening 100 which is significantly smaller than the central opening formed in the plates of the stack and which is significantly smaller than the passageway formed by the tube 88 attached to the top closure plate 90. Due to the restricted opening in the plate 92, a suitable portion of the coolant passing down through the central opening in the plates is forced radially outwardly through the inner flow passages. The remainder of the coolant which can be described as a bypass flow, passes out through the opening 100 and can, for example, be used in other cooling applications such as the cooling of a vehicle engine or to adjust the pressure drop across the heat exchanger. This alternative may be desirable where for example, the amount of coolant that the user wishes to pass through the central opening 86 is more than is required to cool the oil to the required temperature. The opening 100 can be connected by a suitable tube or hose to pass the remaining coolant to another heat exchanger, a radiator or an engine.

Figure 7:
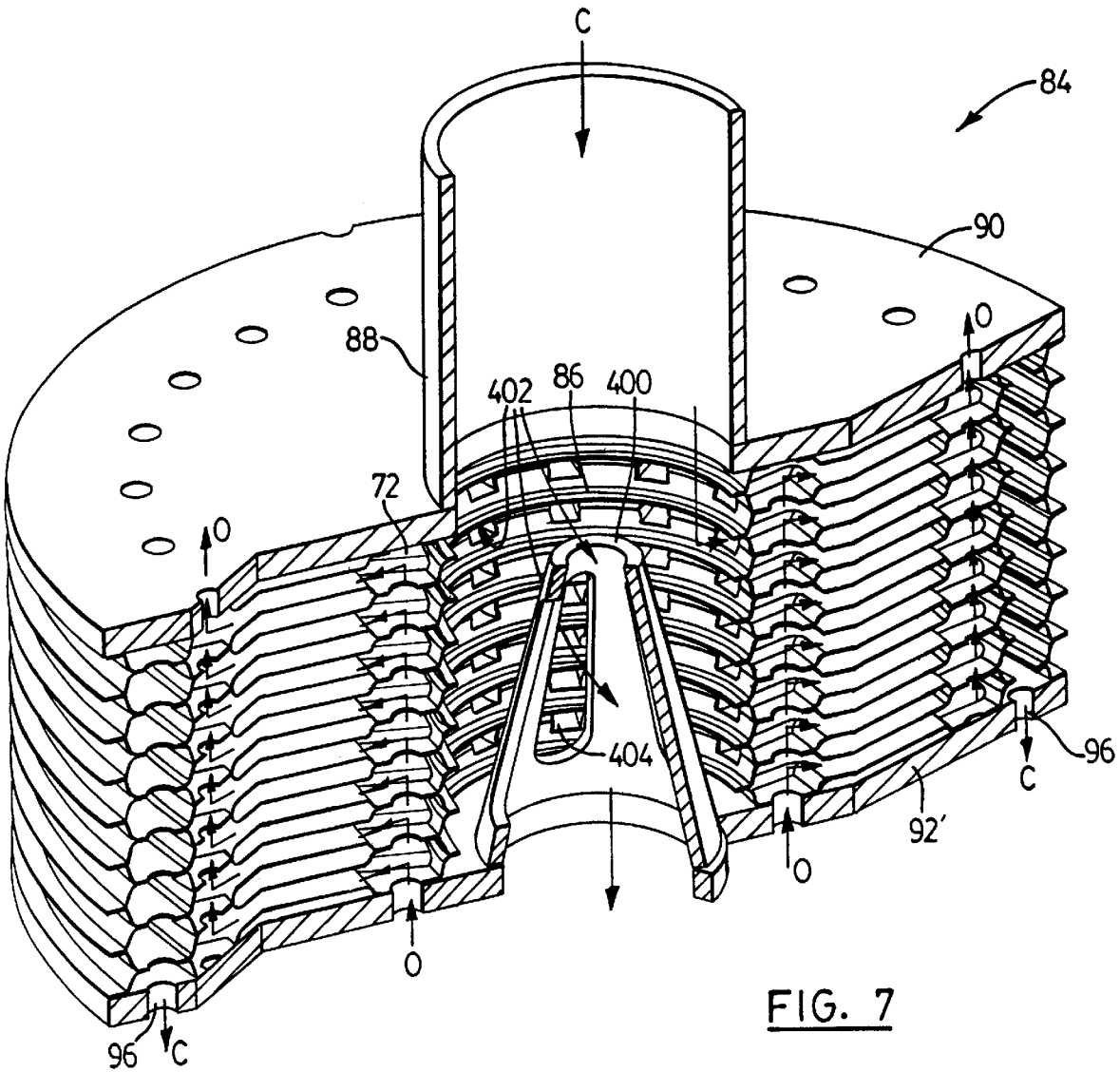
FIG. 7 is an enlarged perspective view similar to FIG. 6 but showing an alternate version of the heat exchanger wherein the central passage has a slotted cone arranged therein for improved fluid distribution.

In another embodiment of the heat exchanger shown in FIG. 7, there is a conical insert or extrusion 400 extending upwardly from the bottom closure plate 92'. It can be seen that this insert in the central passageway 86 acts to improve the flow distribution in the cooler stack. The insert can be a solid insert with no holes therein (not shown) or it can be provided with a central top hole 402 and side slots 404 to permit some flow bypass. The insert 400 can be integrally formed in a center of the plate 92' or can be a separate member fixedly attached thereto.

Figure 3:
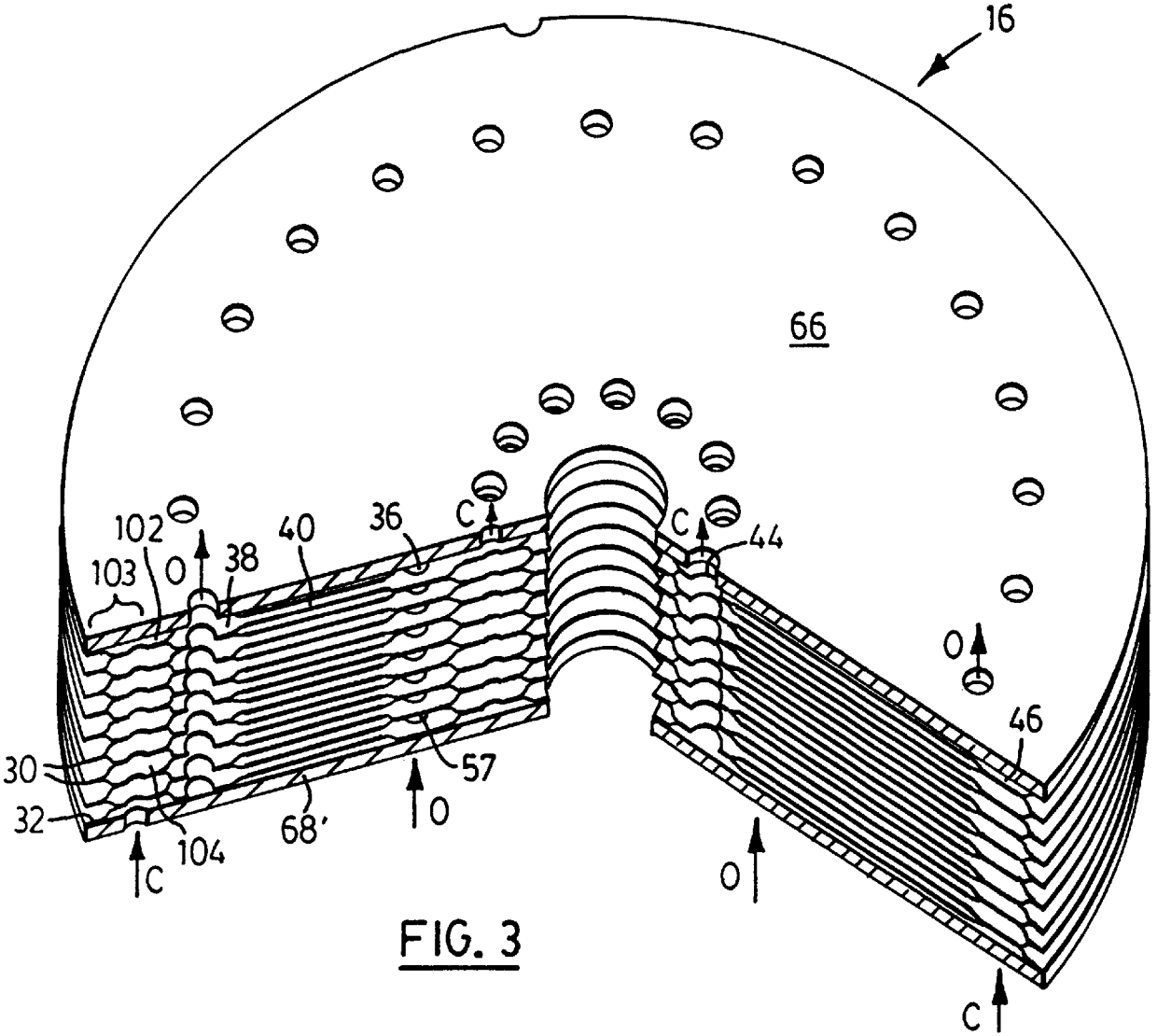
FIG. 3 is an enlarged perspective view, partially broken away, of the heat exchanger employed in the combination shown in FIG. 1, the ribs in the intermediate areas of the plates not being shown for ease of illustration.

In the alternative version of the heat exchanger wherein there is no outer secondary boss formed on each plate, this heat exchanger can be mounted in the above described cylindrical housing similar to the housing 12 shown in FIG. 1 but extending over the cylindrical side of the heat exchanger. The coolant or water is then fed into the annular gap between the cylindrical wall of the housing and the stack of plates. With reference to FIG. 3, the plates of this version would end at the peripheral flange located at 102 and the outer portion of each plate indicated at 103 is not present. The coolant entering into the gap between the housing and the plates passes through the slots formed at 104 and by reason of the cross-over passages formed by the radial ribs 76, the coolant is able to pass between the primary bosses 36 and 38 and through the intermediate areas 40 to reach the manifold or header formed by the inner secondary bosses 44. The coolant C then passes upwardly or downwardly in order to pass out of the heat exchanger either through the top closure plate or the bottom plate.

Figure 8:
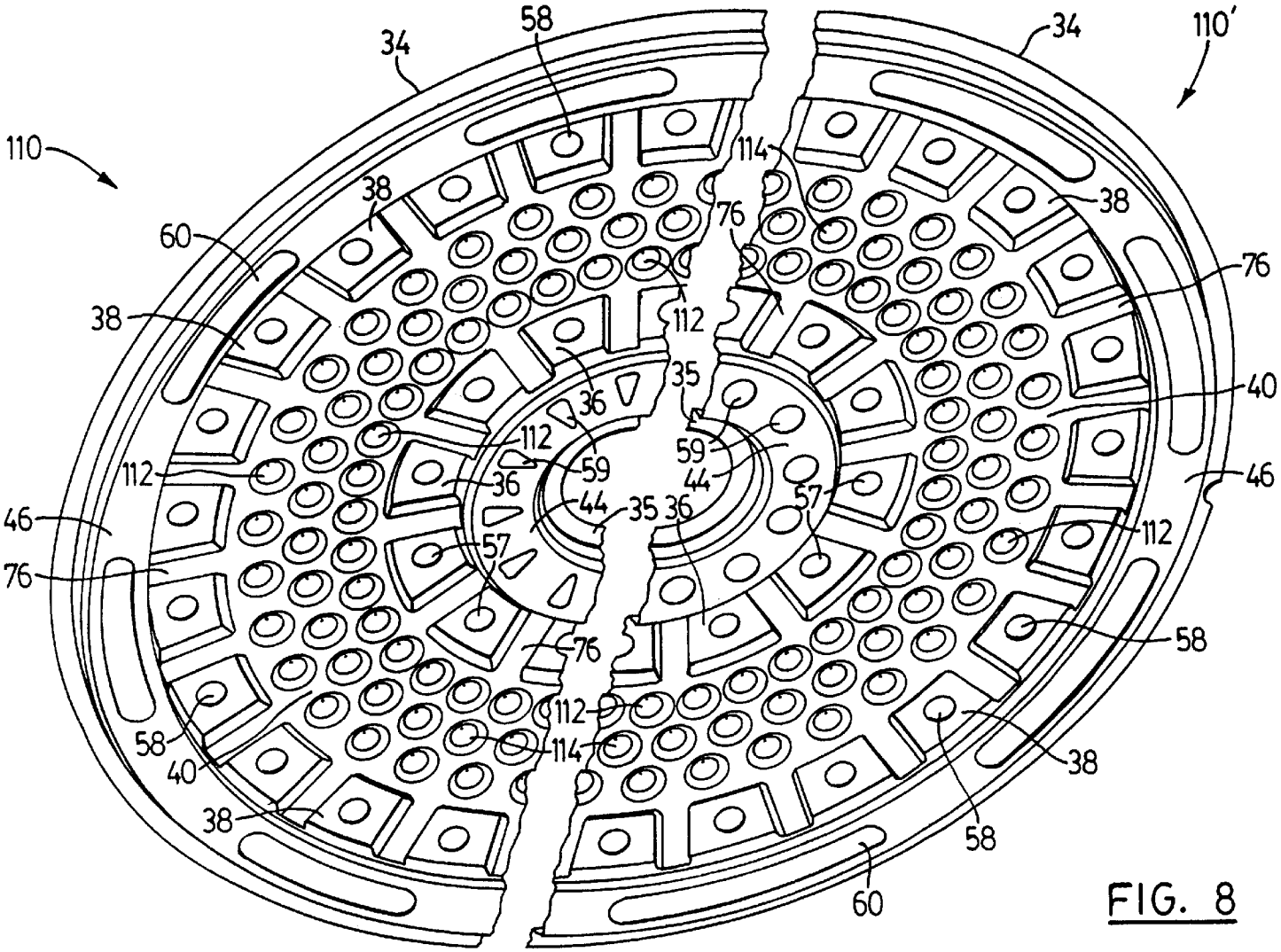
FIG. 8 is a perspective partial view of two versions of another form of ringlike plate that can be used in an annular heat exchanger constructed in accordance with the invention.

Referring next to FIG. 8, two embodiments of ringlike plates 110, 110' are each shown partially, one next to the other. Each plate 110, 110' is similar to the plate 32 of FIG. 2 but has a plurality of spaced-apart dimples 112 and 114 formed in the intermediate area 40 as the flow augmentation means instead of the ribs 52 and grooves 54. In the illustrated embodiments, all three annular rows of dimples 112, 114 extend into the inner flow passages 42. However, these plates can also be made so that the inner and outer rows of dimples 112 extend into the inner flow passages 42 while the dimples 114 of the annular central row extend into the outer flow passages. In other words, in this possible variant the dimples 112 and the dimples 114 would extend in opposite directions from the flat surrounding surface of the intermediate area 40. Obviously various other dimple arrangements are also possible including having the dimples extend only into the outer flow passages, for example the passages through which the oil flows, or it is possible to alternate the dimples of each row with every other dimple extending into the inner flow passages 42 and the alternating dimples extending in the opposite direction. The dimples 112 and 114 have a predetermined height, which in this case of the dimples that extend into the inner flow passages, is preferably equal to the height of the primary bosses 36, 38. However, some or all of the dimples 112, 114 could have a height which is less than that of the primary bosses.

As in the plate 32, the ringlike plates 110, 110' each have an outer peripheral flange 34, an inner peripheral flange 35, and annular inner and outer primary bosses 36 and 38 each having a portion thereof located in a common first plane with the peripheral flanges. The plates 110, 110' also each have inner and outer secondary bosses 44 and 46 each having a flat portion thereof located in a second plane spaced from the first plane and parallel thereto. Each secondary boss is located adjacent to one of the primary bosses and is on the side thereof located furthest from the other of the primary bosses. Again, both the primary bosses and the secondary bosses have openings 57 to 60 therein for the passage of first and second heat exchanging fluids respectively. Again, the outermost openings 60 are preferably elongate, curved slots as shown permitting good fluid flow through these openings.

The only difference between the plates 110, 110' is in the shape of the openings 59. In the case of the plate 110, these openings 59 are somewhat triangular with round edges. The plate 110' has openings 59 which are circular, similar to the openings 59 of plate 32 of FIG. 2.

Also, as in the plate 32, the plate 110 includes radial ribs 76 formed about the circumference of each primary boss 36, 38 and extending substantially across the respective primary boss and each of these radially extending ribs is located between and separated from the openings formed in the primary bosses and form cross over passages that permit one of the heat exchange fluids, for example, the coolant or water, to flow radially across the primary bosses and through the inner flow passages.

Figure 9:
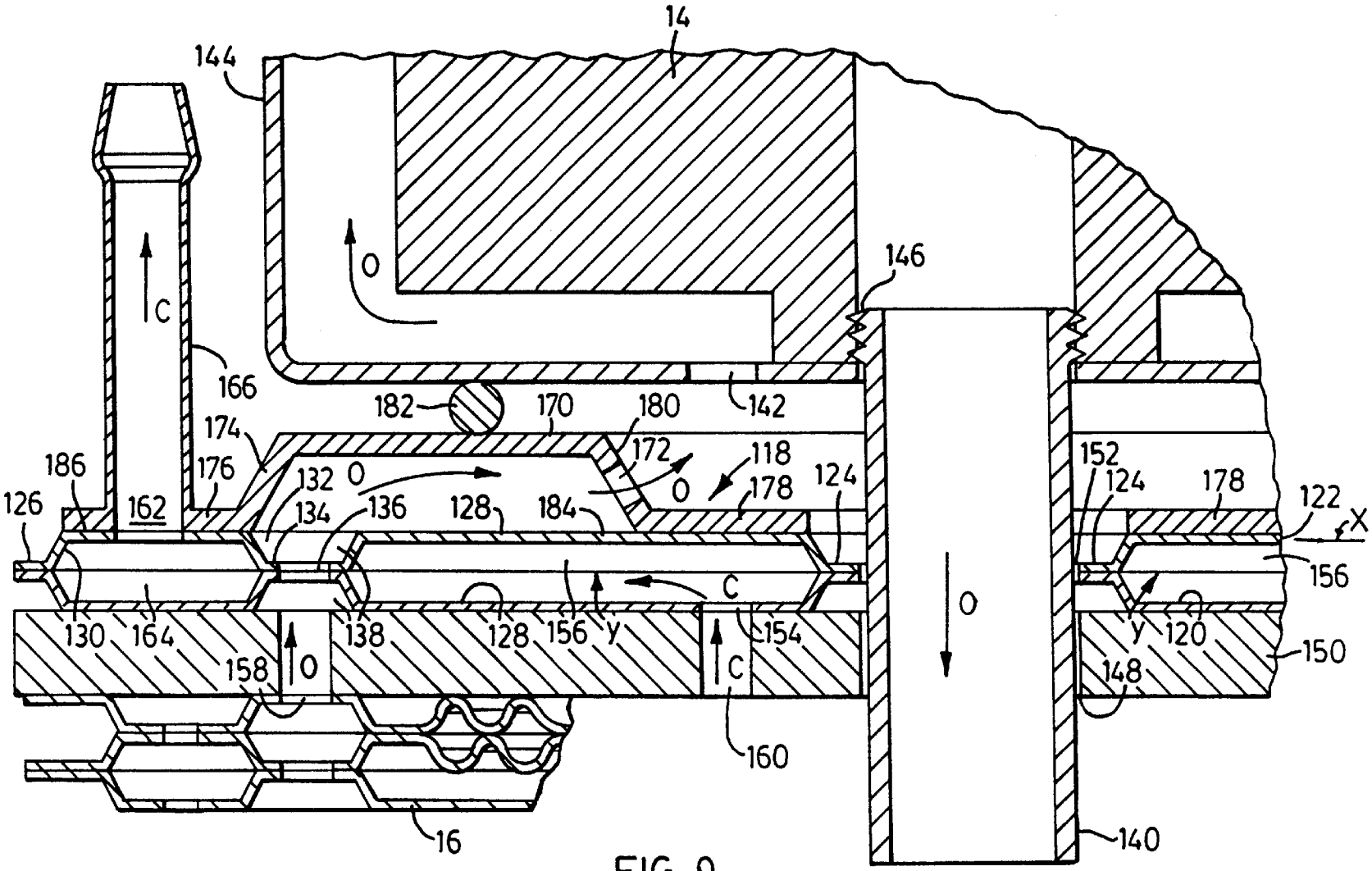
FIG. 9 is an axial cross-sectional view of a manifold for the transfer of two fluids, such as heat exchanging fluids, this manifold being usable with a version of the annular heat exchanger of the invention.
Figure 10:
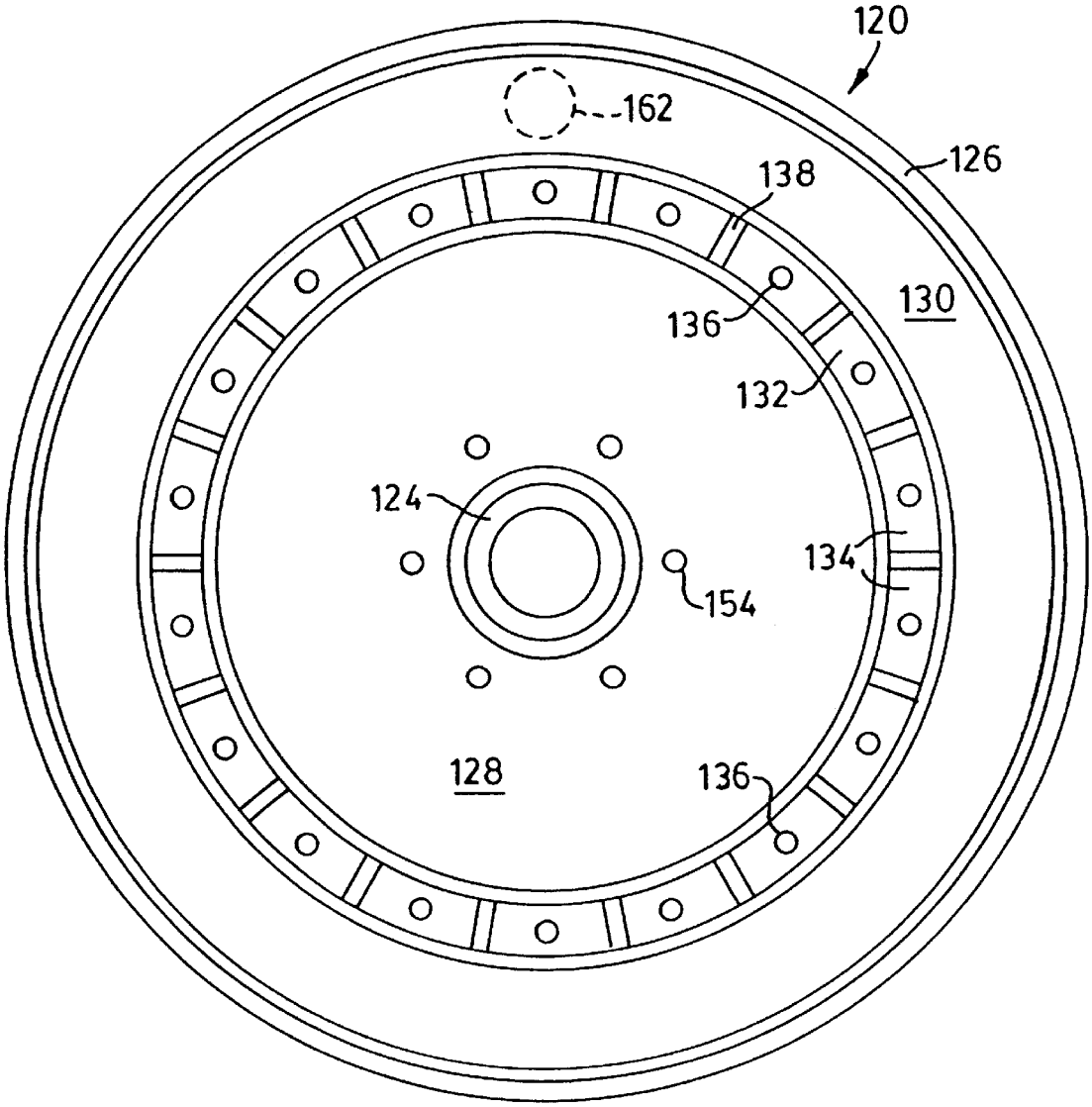
FIG. 10 is a plan view of a ringlike bottom plate used in the manifold shown in FIG. 9.

FIG. 9 is a schematic cross-sectional view taken along a central axis and illustrating a novel manifold 118 that in its broadest applications can be used for the transfer or distribution of two fluids. In particular, the illustrated manifold 118 can be used in conjunction with one or more versions of a heat exchanger 16 constructed in accordance with the present invention, only a portion of such heat exchanger being illustrated in the lower left corner of FIG. 9. The manifold 118 includes a pair of manifold plates 120 and 122 consisting of face-to-face mating ringlike plates each having inner and outer peripheral flanges 124 and 126 and substantially annular, inner and outer bosses 128 and 130 projecting in the same direction from a first plane defined by the outer peripheral flange 126, this plane being indicated by the letter Y. Between the two bosses and separating same is a substantially annular, intermediate channel 132 having a portion 134 located in the aforementioned first plane Y. The channel 132 has a series of spaced apart openings 136, which can be circular, for the passage of a first fluid, for example a heat exchanging fluid such as oil, between the two intermediate channels of the manifold. At least one of the intermediate channels 132 and preferably both of these channels have radially extending ribs 138 formed about the circumference of the channel or channels and extending substantially across the channel or channels 132. These ribs are similar in their construction and arrangement to the aforementioned radially extending ribs 76 in the above described heat exchanger and they serve a similar purpose. The radial ribs 138 are formed between and separated from the openings 136 formed in the channels and the ribs form cross-over passages that permit a second fluid, for example, a second heat exchanging fluid such as a coolant, to flow radially between the inner and outer bosses 128, 130. In the illustrated embodiment of FIG. 9, the flow of first and second heat exchanging fluids through the adjacent heat exchanger 16 and through the manifold 118 is indicated by arrows on the left side of the figure. Again, the letter O has been used to indicate the flow of oil and the letter C has been used to indicate the flow of a coolant such as water. It will be particularly noted that, in the illustrated version, oil passes downwardly through a central passageway formed by threaded pipe 140, this oil having passed through a cylindrical oil filter 14, only a portion of which is shown in FIG. 9. The oil flows through one or more apertures 142 formed in the bottom of an oil filter housing 144. The threaded top end of the pipe 140 can be connected by its threads 146 to a central opening formed in the bottom of the filter housing 144. The pipe 140 extends through a central hole 148 formed in top plate 150 which can be the closure plate of the heat exchanger 16. Pipe 140 also extends through a central aperture 152 formed in the manifold plates 120, 122.

The inner boss 128 of the bottom manifold plate 120 has at least one port or hole 154 formed for the passage of the second fluid, for example the coolant or water, into or out of a sealed first space 156 formed by the two inner bosses 128. It will be appreciated that the space 156 is sealed by the seal joint formed between the two inner peripheral flanges 124 and between the flat portions 134 of the channels.

The aforementioned top closure plate 150 has a first series and a second series of additional holes distributed around the central hole 148. The first series of holes 158 are aligned in a radial direction with an adjacent one of the intermediate channels 132 while the second series of holes 160 are aligned with the holes or ports 154 in the inner boss of the bottom plate for the passage of the second heat exchange fluid, ie. the coolant. As can be seen from FIG. 9, the manifold 118 is mounted on the top plate 150 of the heat exchanger and is sandwiched between the top plate and the filter housing 144.

At least one of the outer bosses 130 is formed with at least one port 162 formed for the passage of the second fluid into or out of a sealed space 164 formed by the two outer bosses 130. It will be understood that the space 164 is sealed by the joining together of the two outer peripheral flanges 126 and the joining of the portions 134 of the channels. The second fluid, for example, coolant C can flow upwardly as shown through a suitable pipe or tube 166. It will thus be seen that the second fluid such as the coolant is effectively routed by the manifold 118 from an inside location below the filter 14 to a readily accessible location located radially outwardly from the filter housing 144.

The manifold also includes means extending over one side of the manifold plates 120, 122 (for example, the top side as shown in FIG. 9) for sealingly enclosing the adjacent intermediate channel 132 of the manifold plates. The preferred illustrated form of this enclosing means is a third plate indicated at 170, this third plate being provided with one or more apertures 172 formed therein and forming a flow passage for the first fluid (for example oil) to flow between the openings 136 in the intermediate channels and the apertures 172. Preferably there are a series of small apertures 172 distributed about the circumference of a substantially annular, centrally located boss 174 formed on the third plate. This boss 174 projects upwardly from a plane defined by an outer peripheral flange 176 of the third plate. Preferably there is also an inner peripheral flange 178 which is firmly connected to the inner boss 128 of the plate 122. As illustrated, the holes 172 are formed in a side wall 180 of the boss 174.

The preferred illustrated manifold is adapted to form a seat to support one end of the filter housing 144 and a suitable annular seal or gasket 182 can be mounted between the top of the boss 174 and the bottom end of the filter housing 144. If desired, or if required, there can also be an annular seal or gasket sealing the joint between the inner peripheral flanges 124 and the pipe 140. As shown in FIG. 9, in the preferred embodiment of the manifold, the inner and outer bosses 128 and 130 each have a portion 184, 186 that is located in a common second plane indicated by the line X in FIG. 9. The second plane is spaced apart and parallel to the first plane Y defined by the outer peripheral flanges. Preferably the aforementioned portions 184 and 186 are planar and as illustrated, the inner portion 184 is substantially wider than the outer portion 186.

It will also be appreciated that the third plate 170 preferably is a third ringlike plate which has inner and outer peripheral flanges. It will be appreciated by one skilled in the art that the third or upper plate 170 can also be different from the plate shown. For example, it can be formed as a flat plate with little or no boss formed thereon. If the third plate is made flat, it can be a thicker plate than the illustrated third plate and formed with channels or grooves to permit the necessary transfer of the heat exchanging fluid such as oil to the desired inner location. Also, although the third plate 170 is shown with an outer flange 176 that extends entirely over the flat portion of the outer boss 130, it is also possible to make the plate with little or no outer peripheral flange. In this case, the pipe 166 can be connected directly to the upper outer boss 130.

Figure 11:
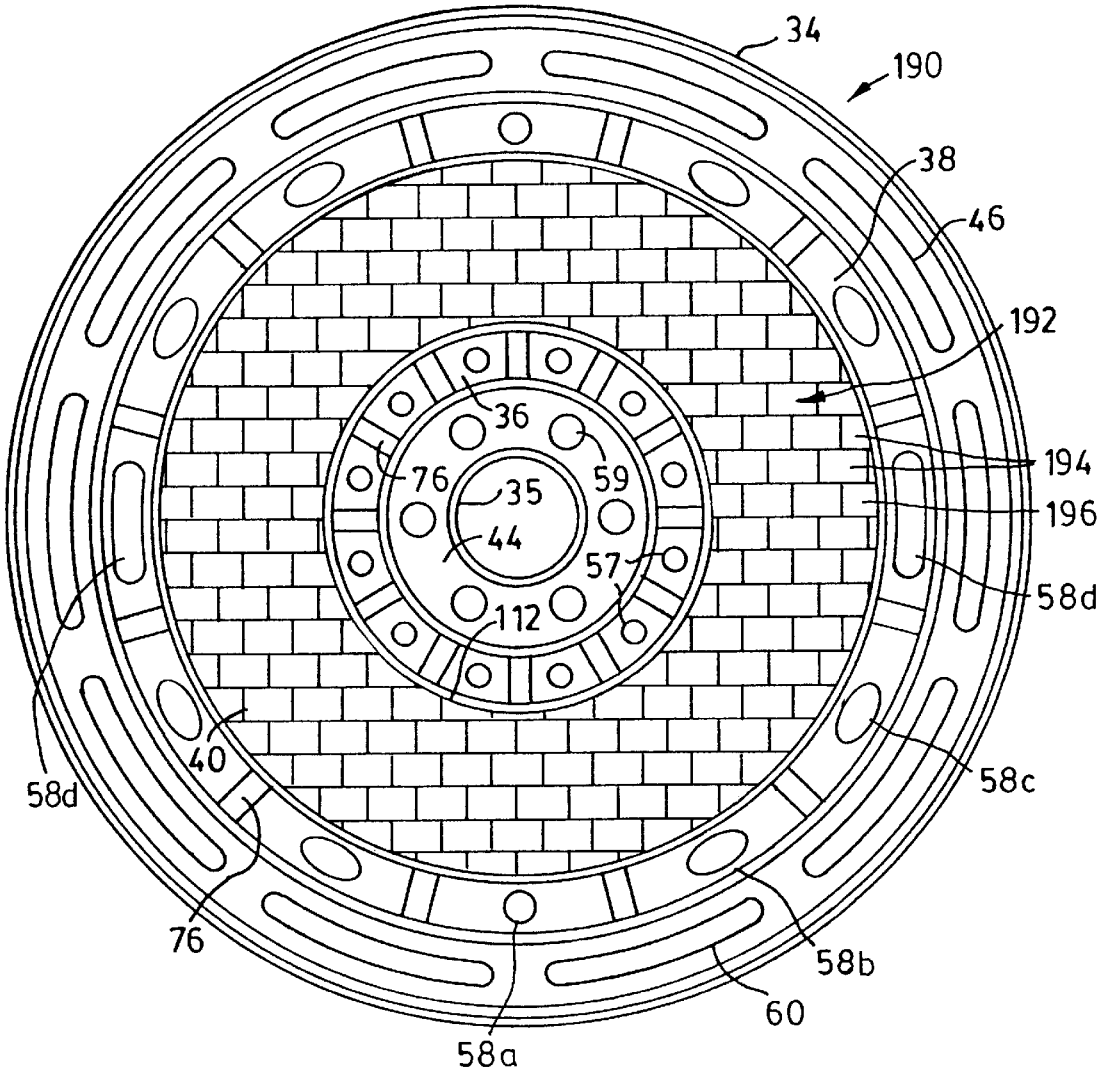
FIG. 11 is a plan view showing another preferred embodiment of a plate used to make another version of the heat exchanger of the invention, this version having turbulizers between the plates.

Turning now to yet another embodiment of a plate and flow augmentation means that can be used to form a stacked plate heat exchanger according to the present invention, this embodiment is shown in FIG. 11 wherein the plate is indicated generally at 190. In this embodiment, the flow augmentation means is an expanded metal turbulizer 192. The turbulizer has an annular shape and generally covers the intermediate area 40. The turbulizer can be located in either the inner flow passages 42 between the plates or in the outer flow passages 50 and preferably is located in both the inner and outer flow passages. The turbulizer can be formed of a material other than expanded metal, such as plastic mesh. FIG. 11 is a view of the plate 190 looking at the oil side or outside of a plate pair. The turbulizer 192 can be any type of known turbulizer. In one form of turbulizer there are rows 194 of S-curved ripples or waves having rounded tops and bottoms, these waves being of uniform size with the waves 196 in one row being staggered with respect to the waves in the adjacent rows. Each turbulizer has a generally flat, annular shape with the thickness or height of the turbulizer preferably being substantially equal to but no greater than the height of the inner or outer flow passageway in which it is located.

As an alternative to the use of a turbulizer, one can use a corrugated fin member as the flow augmentation means. Such fins per se are known in the heat exchanger art and therefore a detailed description herein is deemed unnecessary. In this version, the corrugated fin can be bent around the central hole in the plate and can be made of plastic or metal with metal being preferred.

Some forms of turbulizers will have a flow resistance that varies in a particular direction. Assuming that the turbulizer 192 does have variable flow resistance and, for example, has less flow resistance in the up and down direction as seen in FIG. 11, the apertures or holes in the outer primary boss can be varied in size in order to help maintain a uniform radial flow between the plates and about the circumference of the turbulizer. In the illustrated plate 190 of FIG. 11, the holes in the outer primary boss vary from circular holes 58*a* to somewhat elongated, elliptical holes 58*b* and 58*c* to relatively large, elongated holes or openings 58*d*. In a similar manner, it is also possible to vary the size of the holes 57 in the inner primary boss of the plate although only circular holes 57 are shown in FIG. 11. It is also possible to vary the size of the holes 59 and 60 formed in the inner and outer secondary bosses 44 and 46 in order to compensate for a variation in the flow resistance of the turbulizer through which the second heat exchanging fluid or coolant passes.

Figure 12:
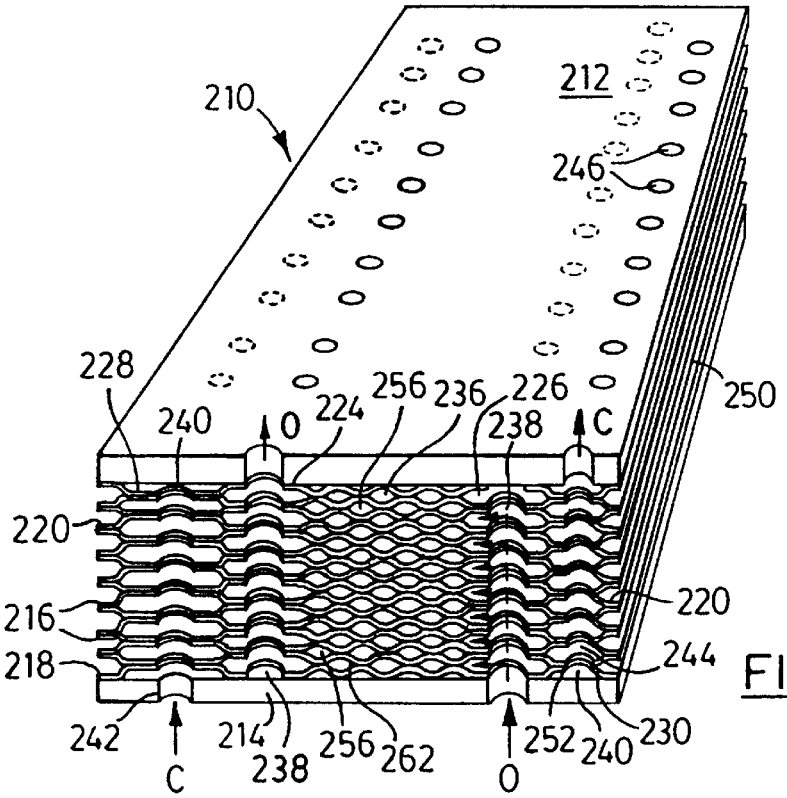
FIG. 12 is a vertical cross-sectional view taken in perspective of a rectangular version of a heat exchanger constructed in accordance with the invention, this view showing the top and a transverse cross-section thereof.

FIG. 12 illustrates another embodiment of a heat exchanger constructed in accordance with the invention, this embodiment being generally indicated at 210. The heat exchanger 210 can have a rectangular (or square) shape in plan view and has an over all box-like configuration. In addition to a top closure plate 212 and a bottom closure plate 214, the illustrated embodiment has a plurality of stacked plate pairs 216 consisting of face-to-face mating plates 218, one of which is shown in plan view in FIG. 13. Each plate 218 has at least one edge flange and the illustrated preferred plate has two edge flanges 220 and 222 extending along opposite long edges thereof. Each plate also has first and second spaced apart, elongate primary ridges 224 and 226 each having a portion thereof located in a common first plane $P_1$ (similar to the primary bosses 36 and 38 of the annular version of the heat exchanger) indicated in FIG. 14. The edge flanges 220, 222 also lie in this common first plane. Also, each plane has at least one elongate secondary ridge and the illustrated preferred embodiment has two elongate secondary ridges 228 and 230 located in a second plane $P_3$ (also indicated in FIG. 15) spaced from the first plane $P_1$ and substantially parallel thereto, these secondary ridges being analogous to the inner and outer secondary bosses 44 and 46 of the annular heat exchanger. Each of the secondary ridges is provided between one of the edge flanges 220, 222 and a respective one of the primary ridges 224, 226. Each plate also has an intermediate area, which can have a rectangular shape, this area being indicated at 232. The intermediate area is located between the first and second primary ridges 224 and 226. It will be understood that the intermediate areas of each plate pair has spaced apart portions to form an inner flow passage 236 between the plates. As can be seen clearly from FIGS. 13 and 14, both the primary ridges and the secondary ridges have openings 238 and 240 formed therein for the passage of first and second heat exchanging fluids respectively. The secondary ridges are arranged such that in back-to-back plate pairs, the secondary ridges 228, 230 are joined (for example, by a brazing process) and their respective openings 240 (which can be elongate slots as shown in FIG. 14) communicate to define two manifolds (in the preferred embodiment) located on opposite sides of the heat exchanger for the flow of the second heat exchanging fluid, for example, the coolant or water as indicated in FIG. 12.

As illustrated, the coolant C can enter through one or more apertures or slots 242 formed in the bottom closure plate 214. After the coolant passes horizontally through the heat exchanger (as seen in FIG. 12) from one side thereof to the other, the coolant flows out of the heat exchanger through the right side manifold indicated generally at 244 and the coolant passes out through a series of outlet openings 246 (which can also be slots, if desired) formed in the top closure plate 212. It will be appreciated that, as in the annular version, it is possible to eliminate or avoid one of the left manifold or the right side manifold 244 for the second heat exchange fluid by enclosing the heat exchanger in a suitably sealed housing that covers one side of the heat exchanger 210 or by providing a separate manifold member (see FIGS. 14A and 14B). For example, the right side manifold 244 can be eliminated if one sealingly encloses the side 250 of the heat exchanger by a suitable housing or cover plate, leaving a generally uniform gap for the flow of the coolant between the side 250 of the heat exchanger and the inner wall of the housing. In such version of the heat exchanger, the individual plates can terminate along an edge flange located at 252.

The intermediate areas of the back-to-back rectangular plate pairs define outer flow passages 256. The outer flow passages 256 can be the same height as the inner flow passage 236 in which case the distance between planes $P_2$ and $P_1$ is half the distance between planes $P_3$ and $P_1$. The passages 256 can also be constructed so as to have a different height than the passages 236 (for example, to accommodate different fluid flow rates). The primary ridges 224 and 226 include ribs 260 extending transversely across the width of each primary rib and distributed along the length of each primary rib. These ribs 260 are located between and separated from the openings 238 formed in the primary ridges and they form cross over passages that permit the second heat exchanging fluid to flow transversely across the primary ridges and through the inner flow passages 236. Again, these ribs can have a uniform height or they can have tops that slope from one end to the opposite end.

Again, as in the annular version of the heat exchangers, the heat exchanger 210 of FIG. 12 is also preferably provided with flow augmentation means that can be located in either the inner flow passages 236 or the outer flow passages 256 and they preferably are located in both the inner and outer flow passages. In the embodiment illustrated by FIGS. 12 and 13, the flow augmentation means indicated generally at 262 comprises a plurality of alternating ribs 264 and grooves 266 formed in the intermediate area 232 between the respective first and second primary ridges. The ribs 264 and grooves 266 are angularly disposed so that the ribs and the grooves in the mating plates cross forming an undulating inner flow passage between the pairs of plates and the ribs and grooves in adjacent back-to-back plate pairs cross forming undulating outer flow passages between the plate pairs.

Figure 13:
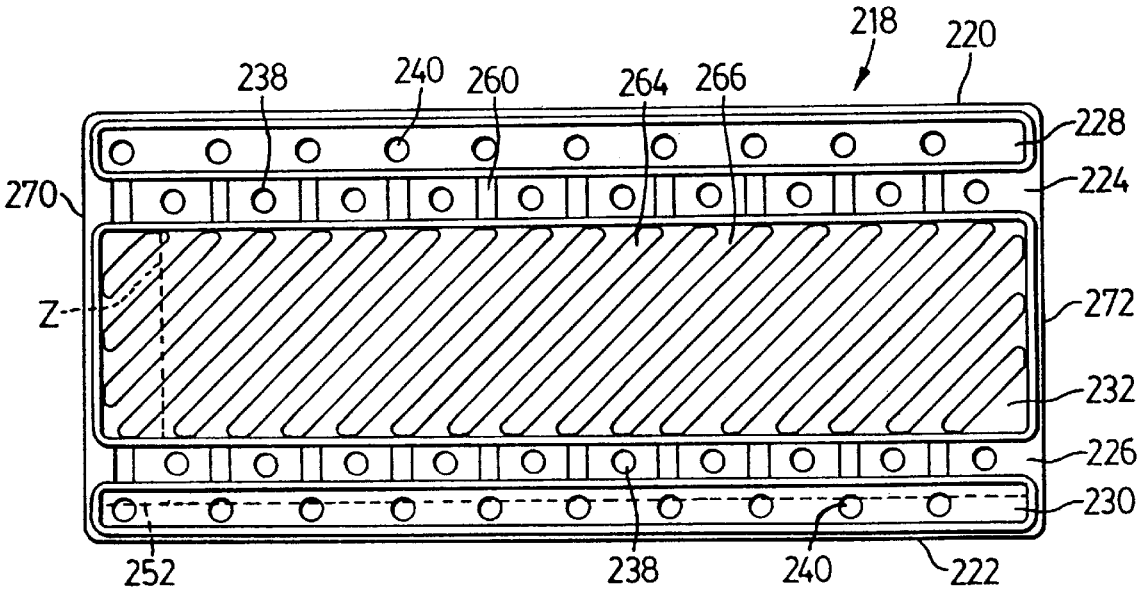
FIG. 13 is a plan view of a rectangular plate used in the heat exchanger of FIG. 12.

In the rectangular version of the heat exchanger, the preferred ribs and grooves are elongate and straight as illustrated in FIG. 13, but it will be appreciated that they could also be somewhat curved in the form of a spiral or involute curve, if desired. The term "angularly disposed" as used herein to describe the ribs and grooves in the rectangular or box-like heat exchangers of this invention means that the rib or groove extends at an angle to the perpendicular line that extends between the primary ridges and that is perpendicular thereto. Such a perpendicular line is indicated in dashed lines at Z in FIG. 13.

It will be noted from FIG. 13 that the two series of holes 238, 240 are shown as offset from one another in the transverse direction. However, it is also quite possible to have these holes aligned in the transverse direction as shown in FIG. 12.

It will be appreciated that other forms of flow augmentation means other than the illustrated ribs and grooves can be used in the rectangular version of the heat exchanger 210. For example, one can employ generally flat, rectangular turbulizers similar in their construction to that illustrated in FIG. 11 (except for their shape) in at least one of the inner and outer flow passages and preferably in both the inner and outer flow passages. Again, the construction of such turbulizers is well known in the heat exchange art and a detailed description herein is deemed unnecessary. It is also possible to employ plastic or metal fins in either or both of the inner and outer flow passages. As a further alternative, the flow augmentation means can comprise a plurality of spaced-apart dimples extending into at least one of the inner flow passages and the outer flow passages and preferably into both of these passages.

It will be appreciated that FIG. 12 is a transverse vertical cross-section of the heat exchanger with a short end portion of the heat exchanger cut away for ease of illustration. It will be further appreciated that the edges of the stacked plate pairs are sealed closed by joining edge flanges which preferably extend around the entire perimeter of each plate as illustrated in FIG. 13. Thus, in addition to the aforementioned edge flange 220 and 222 on the opposite long sides of the plate, there are also side edge flanges 270 and 272 that extend between the flanges 220 and 222. In this way, it will be appreciated that both the inner flow passages and the outer flow passages are enclosed along both of their short side edges preventing the heat exchanging fluids from escaping through these edges. It will be appreciated that there are other ways of closing these end edges of the plates other than by the use of edge flanges, if desired. For example, flat end plates (not shown) can extend across the opposite ends of the plate pairs to enclose and seal these ends. These end plates can be sealingly attached by known brazing processes.

In the embodiment of FIG. 12, the illustrated top closure plate 212 encloses or covers the two secondary ridges 228 and 230 at the top end of the stack of plate pairs. However, it will be appreciated that if the secondary ridges on one side are omitted so that there is only a manifold on the opposite side for the second heat exchanging fluid, then the top closure plate would enclose or cover only one of the secondary ridges at the top end. Also, the illustrated top closure plate includes flow ports for the flow of both the first heat exchanging fluid and the second heat exchanging fluid therethrough but again, if the secondary ridges on one side were omitted, for example, on the right side in FIG. 12, the top closure plate can have only flow ports for the first heat exchanging fluid or oil. The same comments apply equally to the bottom closure plate 214. It will further be noted that if the uppermost plate 218 is omitted from the heat exchanger of FIG. 12 so that the top closure plate 212 is lowered by the thickness of one plate, then the top closure plate would effectively be used to enclose or cover the two primary ridges 224 and 226 of the top end of the stack of plate pairs instead of the secondary ridges.

Figure 14A:
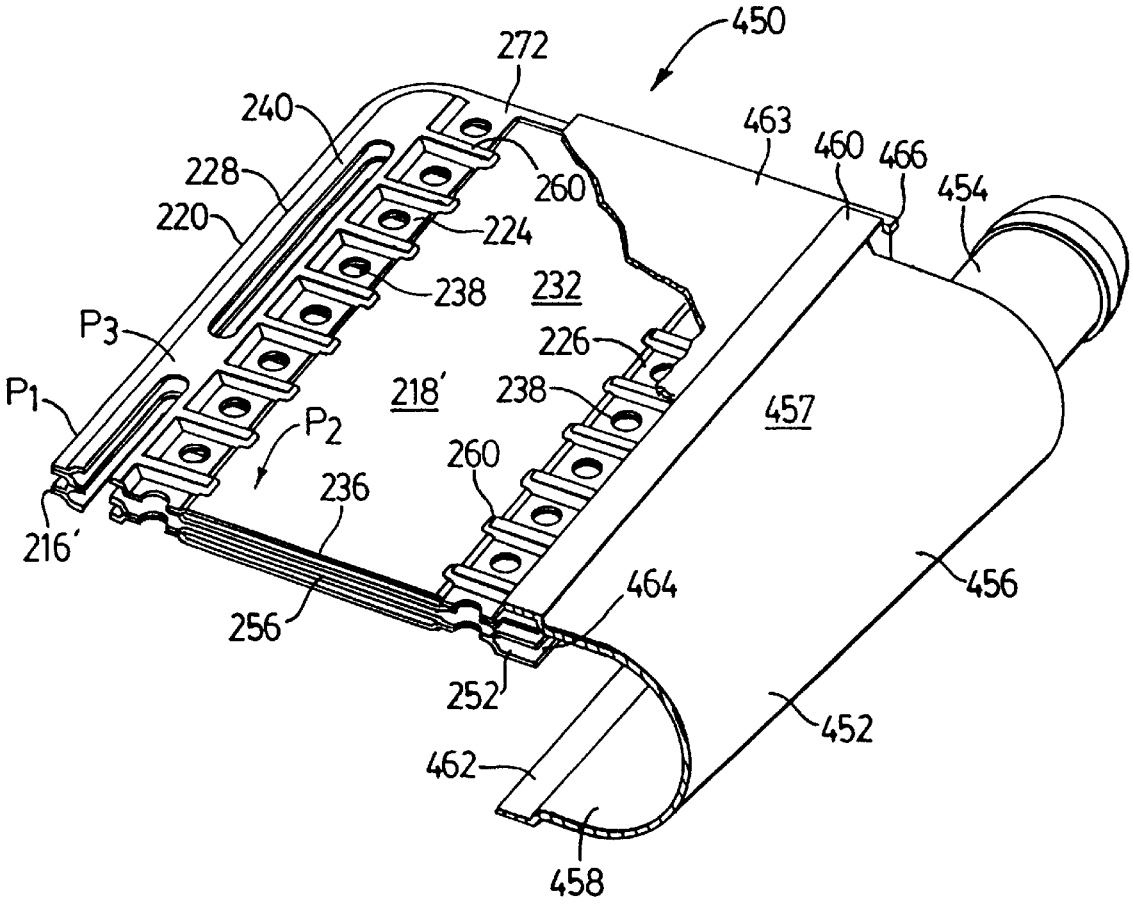
FIG. 14A is a perspective and transverse vertical cross-section showing a top side of a rectangular plate mounted on two similar plates to form a portion of a rectangular heat exchanger, this view illustrating part of an enlarged edge manifold arranged on the right side.
Figure 14B:
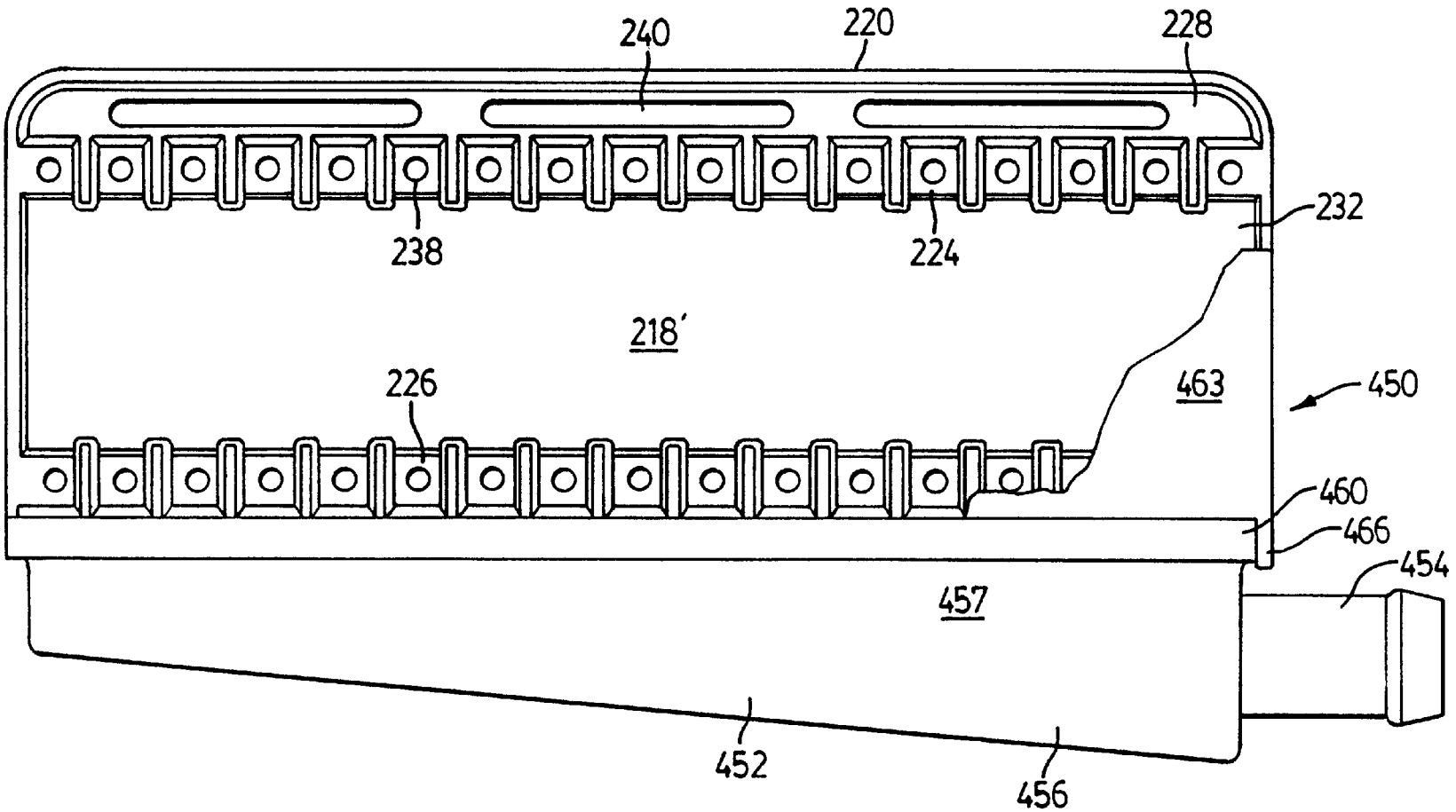
FIG. 14B is a top view, with a top plate broken away, showing the rectangular heat exchanger of FIG. 14A and the entire length of the edge manifold.

FIG. 14A is a partial perspective view of a rectangular heat exchanger for which only three plates are shown in vertical section. This embodiment indicated generally by reference 450 has many features in common with the embodiment of FIGS. 12 and 13 and only the differences will be described herein. The heat exchanger has no right side secondary ridge 230 but the plates terminate on the right side edge with the edge flange 252. The right side of the heat exchanger is enclosed by an edge manifold 452 having a tubular pipe 454 connected to an end thereof. The pipe 454 can be an inlet or an outlet for the coolant (C). The illustrated manifold has a generally semi-cylindrical wall 456 which preferably is tapered from one end to the other as shown in both FIGS. 14A and 14B. There are also top and bottom flat wall extensions 457, 458 with edge flanges 460, 462 that are sealingly joined to the top and bottom plates of the heat exchanger with only part of the top plate 463 shown. It will be understood that if the manifold 452 is an inlet manifold, the coolant will enter the inner flow passages 236 between each pair of plates 218' by passing into the elongate slots 464 formed between two edge flanges 252.

If desired, the top plate 463 and bottom plate of the heat exchanger can be formed with locating tabs 466 on corners thereof adjacent to the edge manifold. These tabs are inserted into corner recesses formed in corners of the edge manifold, this arrangement helping to ensure that the manifold is correctly positioned before it is permanently attached such as by brazing.

Figure 15:
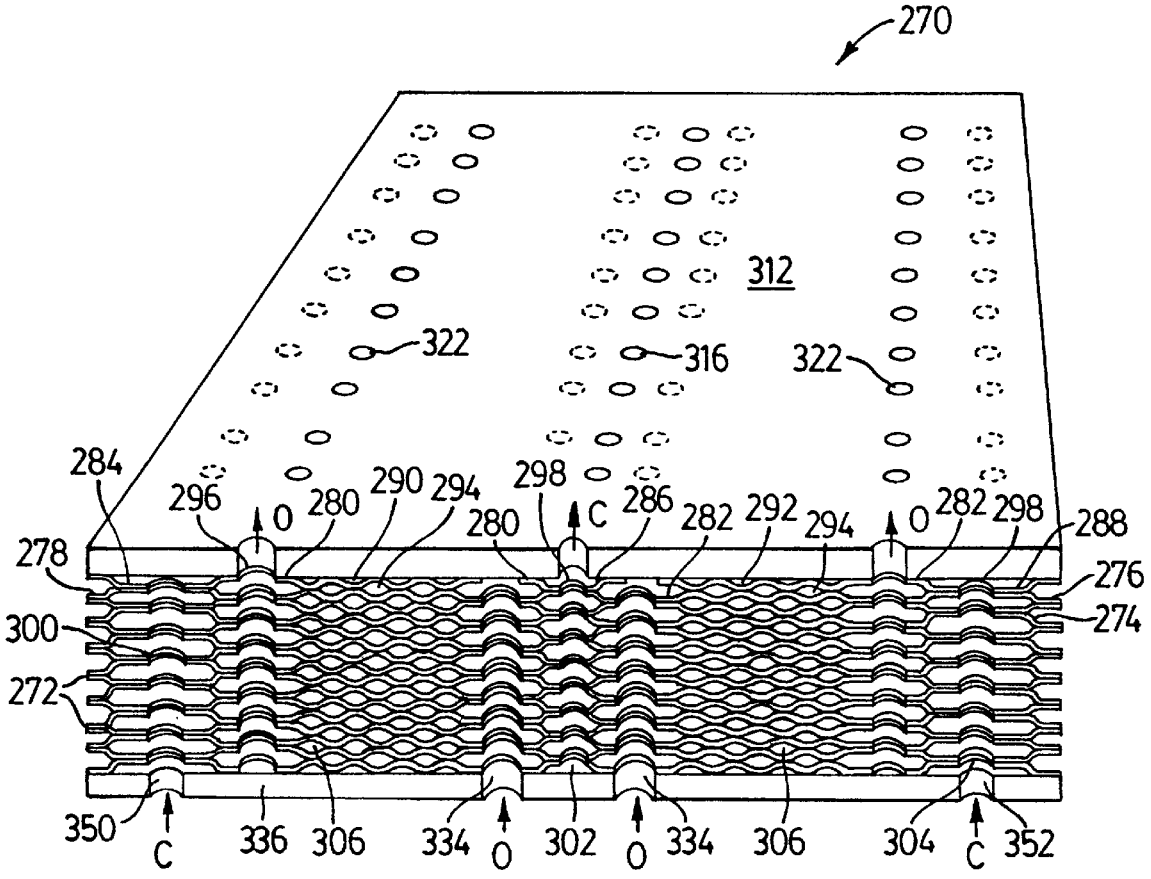
FIG. 15 is a vertical cross-sectional view taken in perspective of another version of rectangular heat exchanger constructed in accordance with the invention, this version having two inlets for each of the heat exchanging fluids in the bottom manifold plate and this view showing the top and a transverse cross-section.
Figure 16:
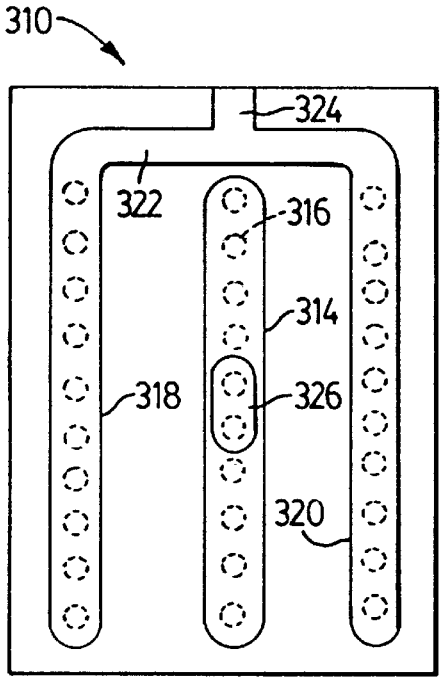
FIG. 16 is a bottom view of a top manifold plate used in the heat exchanger of FIG. 15.
Figure 17:
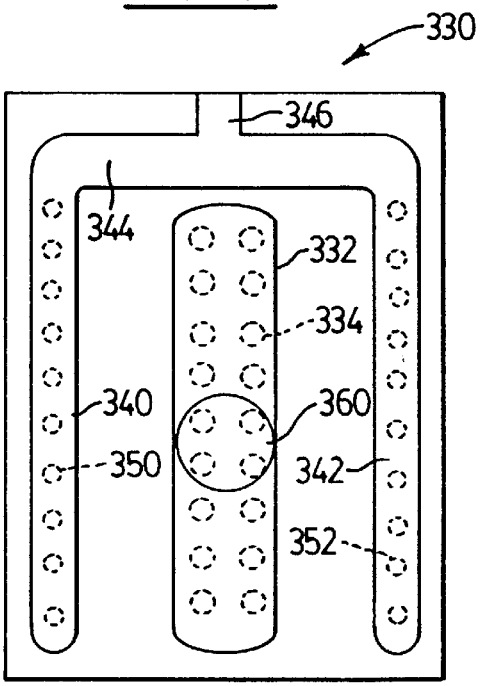
FIG. 17 is a top view of the bottom manifold plate used in the heat exchanger of FIG. 15.

Turning now to the heat exchanger illustrated in FIG. 15 and its top and bottom manifolds as illustrated in FIGS. 16 and 17, this heat exchanger indicated generally at 270 has a number of features in common with the above described rectangular or box-like heat exchanger 210 of FIG. 12. Accordingly, only those features of the heat exchanger 270 which differ from the heat exchanger 210 will be described herein. This heat exchanger has a plurality of stacked plate pairs 272 consisting of face-to-face mating plates 274. Each plate has edge flanges, including edge flanges 276 and 278 extending along edges thereof, preferably all four edges thereof, and first and second pairs of spaced apart, elongate primary ridges 280 and 282. Each of these ridges has at least a portion thereof located in a common first plane (identified as $P_1$ in FIG. 18) with its edge flanges such as the illustrated flanges 276 and 278. Each plate also has three spaced-apart elongate secondary ridges 284, 286 and 288. Each of these ridges has a portion thereof located in a second plane (identified as $P_3$ in FIG. 18) which is spaced from the first plane and is parallel thereto. The secondary ridges include a central ridge 286 and two outer ridges 284, 288 located on opposite sides of the central ridge and spaced a substantial distance therefrom. As can be seen from FIG. 15, each of the outer ridges 284, 288 is separated from the central ridge by one of the pairs, 280, 282 of primary ridges and an intermediate area 290, 292 located between the respective pair of primary ridges. As in the other embodiments of the heat exchangers of this invention, the intermediate areas 290, 292 of each plate pair have spaced-apart portions forming inner flow passages 294 between the plates of the pair.

Both the primary ridges 280, 282 and the secondary ridges 284, 286 and 288 have openings 296 and 298 for the passage of first and second heat exchanging fluids respectively, these fluids being represented again symbolically by letters O and C in FIG. 15. The secondary ridges 284, 286 and 288 are arranged such that in back-to-back plate pairs, the secondary ridges are joined and their respective openings thereof communicate to define three separate manifolds 300, 302 and 304 for the flow of the second heat exchanging fluid which can be the coolant or water C. Also, the intermediate areas 290, 292 of the back-to-back plate pairs have spaced apart portions defining outer flow passages 306 through which the second heat exchanging fluid can flow. As in the embodiment illustrated by FIGS. 12 and 13, preferably all of the primary ridges 280, 282 include ribs 260 that extend transversely across the width of each primary ridge and that are distributed along the length of each primary ridge. These ribs, which can be the same in their arrangement and construction as those illustrated in FIG. 13, are located between and separated from the openings 296 in the primary ridges and they form cross-over passages that permit the secondary heat exchanging fluid to flow transversely across a respective one of the pairs of primary ridges and through the inner flow passages 294.

Figure 18:
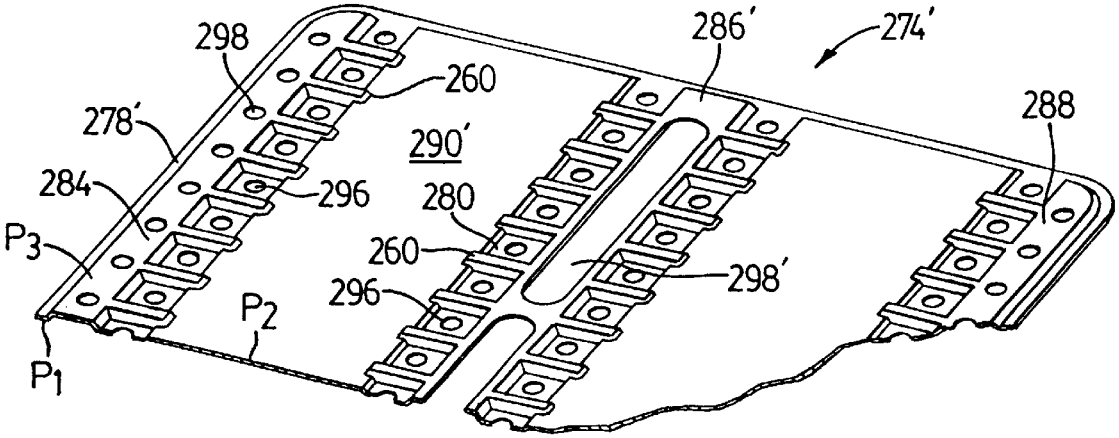
FIG. 18 is a perspective view, with portions broken away, showing the top side of a rectangular plate that can be used in the type of heat exchanger illustrated in FIG. 15.
Figure 19:
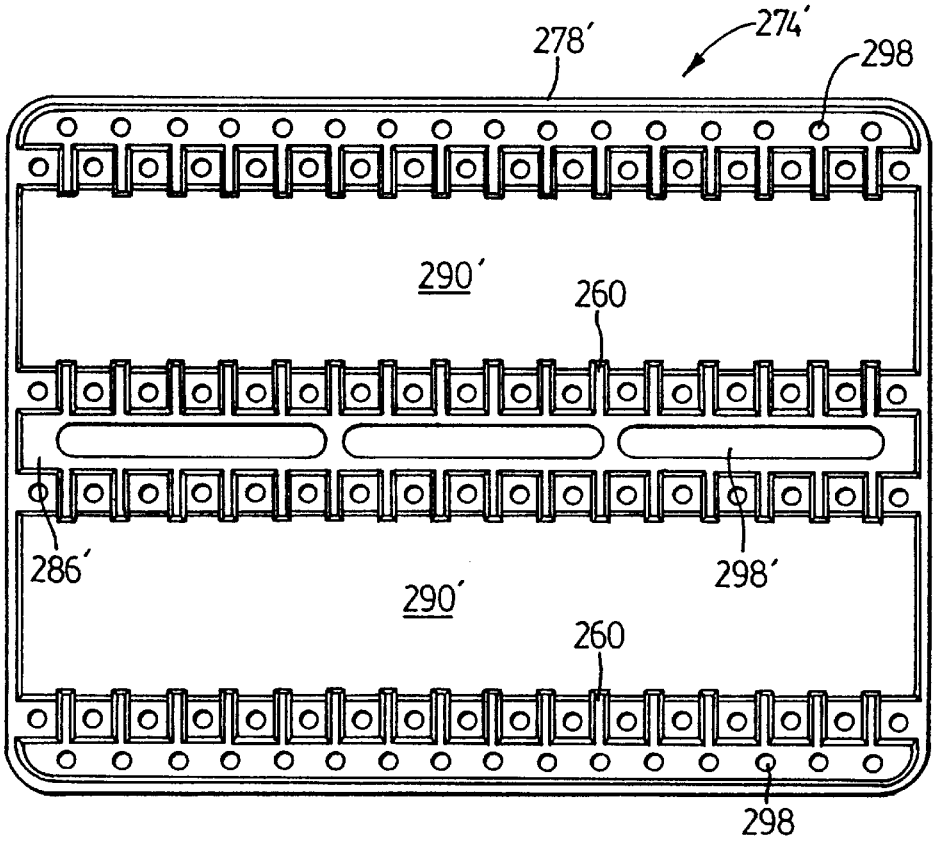
FIG. 19 is a top view of the rectangular plate shown in FIG. 18 showing the entire plate.

In FIG. 15, the openings 296 and 298 are shown as aligned in the transverse direction of the plates. However, it is also possible for the sets of openings 296 to be offset from the sets of openings 298 as illustrated in FIGS. 18 and 19.

As with the previous embodiments, flow augmentation means can be located in either the inner flow passageways 294 or the outer flow passages 306 and preferably such flow augmentation devices are located in most of the passages. Again, the flow augmentation means can take the form of alternating ribs and grooves arranged in the manner illustrated in FIG. 13, these ribs and grooves formed in the intermediate areas 290, 292 located between the pairs of primary ridges 280, 282. Alternatively, the flow augmentation means can comprise generally flat, rectangular turbulizers whose construction is known per se, located in either the inner flow passages or the outer flow passages and preferably in both these sets of passages. A further alternative is the use of a plurality of dimples extending into either the inner flow passages, the outer flow passages or preferably into both sets of passages.

FIGS. 16 and 17 illustrate top and bottom manifold plates that can be used in the heat exchanger 270 of FIG. 15. With respect to the top manifold plate 310, it can either replace the top closure plate 312 shown in FIG. 15 or it can be mounted in a close fitting, sealing manner on top of the plate 312. The illustrated plate 310 has an elongate central groove or recess 314 extending along its bottom surface and extending over all of central holes 316 of the plate 312 or, in the case of a direct mounting, extending over all of the central openings 298 formed in the top central secondary ridge 286, the location of these holes being indicated by the dashed holes 316 indicated in FIG. 16. Instead of small circular holes 298, these central holes can be a few elongate slots 298' as illustrated in the plate shown in FIG. 18. Extending along opposite sides of the groove 314 are two further elongate grooves 318 and 320 which form parallel arms that are joined by a connecting groove 322. Each of the grooves 318, 320 extend over all of the respective outer row of holes 322 formed in the top closure plate 312 or over the respective row of holes or openings 296 formed in the outer primary ridges. The first heat exchanging fluid or oil can pass out from beneath the plate 310 through a short, end passageway 324, the end of which can be connected to a suitable pipe or hose (not shown) for example. The second heat exchange fluid or coolant that passes into the central groove 314 can flow therefrom through a central opening 326 formed in the center of the manifold plate. Again, the top end of the opening 326 can be connected to a suitable pipe or hose for the coolant.

The bottom manifold plate 330 works in a similar fashion to the plate 310. However, the bottom manifold plate has a wider, elongate central groove 332 that extends most of the length of the plate. The groove 332 extends over the bottom end of two rows of apertures 334 formed in the bottom closure plate 336 or, in the case where the manifold plate 330 replaces the bottom closure plate 336 of FIG. 15, the recess 332 extends over the openings 296 of the two inner primary ridges 280, 282. The location of these openings 334 is indicated in dashed circles in FIG. 17. Located on opposite sides of the central groove are two elongate parallel grooves 340 and 342 which are connected at one end by a connecting passageway 344. Extending centrally from the passage 344 is a short end passageway 346 which, at its outer end, is connected to a suitable pipe or tube for the transfer of the second heat exchanging fluid or coolant. Again, the two grooves 340, 342 either extend over the rows of apertures 350, 352 formed in the bottom closure plate or, in the case where the plate 330 replaces the bottom plate of FIG. 15, these grooves extend over the bottom of the bottom openings 298. The location of the openings 350, 352 relative to the manifold plate is indicated by dashed circles in FIG. 17. Preferably the openings 350, 352 and the openings 298 in the plates are smaller than, for example one half the size of, the apertures 316 and the openings 298 in the central secondary ridge. It will be understood that oil can be fed into the elongate central groove 332 by means of a large central aperture or hole 360 formed in the center of the plate 330. Again, a suitable pipe or tube can be connected to the outside of the plate 330 to transfer the first heat exchanging fluid or oil to the central groove 332.

FIGS. 18 and 19 illustrate one form of heat exchange plates 274' that can be used in a rectangular type of heat exchanger of the type shown in FIG. 15. The flow augmentation means, which as indicated can take various forms, as been omitted from these figures for ease of illustration. In these plates the single central secondary ridge 286' is substantially wider than the other ridges to accommodate the larger fluid flow through the central manifold. Also, the ridge 286' has relatively large, elongate slots 298' formed therein allowing for substantial flow of coolant in the vertical direction perpendicular to the plates 274'. Each plate 274' has an edge flange 278' that extends about the perimeter of the plate and that is used to seal this perimeter when connected to the edge flange 278' of the other plate in the pair. It will be noted that the intermediate areas 290' lie in a plane $P_2$ that is parallel to and between the two planes $P_1$ and $P_3$. The illustrated ribs 260 have flat tops that lie in the plane $P_3$.

It will be understood that various modifications and changes can be made to the various heat exchangers as described above without departing from the spirit and scope of this invention. Accordingly, all such modifications and changes as fall within the scope of the accompanying claims are intended to be part of this invention.

I claim:

1. A heat exchanger comprising:

a plurality of stacked plate pairs consisting of face-to-face, mating ringlike plates, each plate having a peripheral flange, annular inner and outer primary bosses each having a portion thereof located in a common first plane with said peripheral flange, an annular secondary boss having a portion thereof located in a second plane spaced from said first plane and parallel thereto, and an intermediate area located between said inner and outer primary bosses, said peripheral flanges and said primary bosses in said mating plates being joined together, the intermediate areas of each plate pair having spaced-apart portions to form an inner flow passage between the plates;

the secondary boss of each plate being located adjacent to one of said primary bosses and on a side thereof furthest from the other of said primary bosses;

both said primary bosses and said secondary bosses having openings formed therein for passage of first and second heat exchanging fluids respectively;

said secondary bosses being arranged such that in back-to-back plate pairs, the secondary bosses are joined and the respective openings therein communicate to define a manifold for the flow of said second heat exchange fluid, and the intermediate areas of back-to-back plate pairs defining outer flow passages therebetween, wherein said primary bosses of at least one plate of each pair include radially extending ribs formed about the circumference of at least one primary boss of the at least one plate and extending substantially across the respective primary boss, said ribs being located between and separated from said openings formed in the primary boss and forming crossover passages so that the crossover passages of each plate pair permit said secondary heat exchange fluid to flow across its respective primary bosses and through its respective inner flow passage.

2. A heat exchanger according to claim 1 wherein said peripheral flange is an outer peripheral flange located radially outwards from said primary and secondary bosses and said secondary boss is an outer secondary boss located radially outwards from its respective outer primary boss.

3. A heat exchanger according to claim 2 including an annular inner secondary boss formed on each plate and having a portion thereof located in said second plane, said inner secondary boss being located radially inwardly from and adjacent to its respective inner primary boss, and wherein the inner secondary bosses have openings formed therein for passage of said second heat exchange fluid and are joined together so that their openings communicate to define a second inner manifold for the flow of the second heat exchange fluid.

4. A heat exchanger according to claim 3 wherein each plate has an inner peripheral flange projecting radially inwardly from its respective inner secondary boss and located in said first plane with said portions of its respective primary bosses, the inner peripheral flanges on back-to-back plate pairs being joined to close and seal said second inner manifold.

5. A heat exchanger according to claim 2 and further comprising an oil filter having an inlet and an outlet, top and bottom closure plates located respectively on the top of and bottom of the stacked plate pairs, and a central conduit extending through the central holes in said plate pairs and through said closure plates and sealingly engaged with said closure plates, said central conduit being provided for the flow of the first heat exchange fluid comprising oil into or out of said oil filter and communicating with one of the filter inlet and outlet, wherein said closure plates and said conduit form an annular space extending about said conduit and providing a header for the flow of said second heat exchange fluid, and wherein said bottom closure plate has a first flow port for the flow of the second heat exchange fluid into said header and a second flow port for the flow of said first heat exchange fluid comprising oil into or out of said first mentioned header enclosing said primary bosses.

6. A heat exchanger according to claim 2 wherein a central passage extends along a central axis of the stacked plate pairs and provides a fluid flow passage for the secondary heat exchange fluid, and a conical insert is mounted centrally in said central passage for purposes of flow distribution through the inner flow passages, said conical insert tapering outwardly in the direction of flow of said secondary heat exchange fluid in said central passage.

7. A heat exchanger according to claim 6 wherein said conical insert has holes formed therein to allow restricted bypass flow of said secondary heat exchange fluid past a downstream end of said central passage.

8. A heat exchanger according to claim 1 further comprising flow augmentation means located in one of the inner flow passages and outer flow passages.

9. A heat exchanger according to claim 8 wherein said flow augmentation means comprises a turbulizer located in at least one of the inner flow passages and outer flow passages.

10. A heat exchanger according to claim 8 wherein the flow augmentation means comprises a plurality of spaced-apart dimples extending into at least one of the inner flow passages and the outer flow passages.

11. A heat exchanger according to claim 1 further comprising flow augmentation means located in both the inner flow passages and the outer flow passages.

12. A heat exchanger according to claim 11 wherein the flow augmentation means comprises a plurality of alternating ribs and grooves formed in said intermediate area between the inner and outer primary bosses, said ribs and grooves being angularly disposed so that the ribs and grooves in the mating plates cross forming an undulating inner flow passage between the pair of plates, and the ribs and grooves in adjacent back-to-back plate pairs cross forming undulating outer flow passages between plate pairs.

13. A heat exchanger according to claim 12 wherein the ribs and grooves have a predetermined height and wherein said secondary boss has a height substantially greater than the rib and groove predetermined height.

14. A heat exchanger according to claim 12 wherein said ribs have a first predetermined height, said grooves have a second predetermined height, and said secondary boss has a height equal to the total of said first and second predetermined heights.

15. A heat exchanger according to claim 1 wherein said flow augmentation means comprises turbulizers located in both the inner flow passages and the outer flow passages.

16. A heat exchanger according to claim 11 wherein the flow augmentation means comprises a plurality of spaced-apart dimples extending into both the inner flow passages and the outer flow passages.

17. A heat exchanger according to claim 16 wherein said dimples have a predetermined height and wherein the annular primary bosses have a height that is at least as high as the dimple height.

18. A heat exchanger according to claim 1 including at least one closure plate enclosing at least one of said primary and secondary bosses at one end of the stack of plates pairs, said at least one closure plate including at least one flow port for the flow of at least one of said first and second heat exchanging fluids therethrough.

19. A heat exchanger according to claim 1 including top and bottom closure plates each enclosing at least one of said primary and secondary bosses at its respective end of the stack of plate pairs, each closure plate enclosing at least one flow port for the flow of at least one of the first and second heat exchanging fluids therethrough.

20. A heat exchanger according to claim 1 and further comprising a further end plate covering said stack of plate pairs at another end opposite said one end, said end plate having holes formed therein for the passage of said first and second heat exchange fluids, and a manifold mounted on said end plate comprising three stacked manifold plates consisting of first, second and third ringlike plates, the first and second ringlike plates each having inner and outer peripheral flanges and annular inner and outer manifold bosses each having a portion thereof located in a common first plane, and an annular intermediate channel located between said inner and outer manifold bosses and having openings for passage of said first heat exchange fluid;

said intermediate channel including radial ribs formed about the circumference of the channel and extending substantially across the channel, said radial ribs forming cross-over passages that permit the second heat exchange fluid to flow radially between said inner and outer manifold bosses;

the outer manifold boss of the second plate having at least one outlet port formed for outflow of the second heat exchange fluid;

wherein said third plate extends over and sealingly encloses said intermediate channel in said second plate, has apertures formed therein, and forms a flow passage for said first heat exchange fluid to flow between the intermediate channel in said second plate and said apertures in the third plate, wherein at least some of said holes in said end plate are located opposite the intermediate channel in said first ringlike plate and at least further of said holes in said end plate are located opposite holes formed in the inner manifold boss of the first ringlike plate.

21. A manifold for the transfer or distribution of two fluids, said manifold comprising:

a pair of manifold plates consisting of face-to-face, mating ringlike plates each having inner and outer peripheral flanges, substantially annular inner and outer bosses projecting in the same direction from a first plane defined by said outer peripheral flange, and a substantially annular intermediate channel located between the inner and outer bosses and having openings for passage of a first fluid between the two intermediate channels;

at least one of said intermediate channels having radial ribs formed about the circumference of the channel and extending substantially across the channel, said radial ribs being formed between and separated from said openings formed in the channels and forming cross-over passages that permit a second fluid to flow radially between said inner and outer bosses;

at least one of said outer bosses having at least one port formed for passage of the second fluid into or out of a sealed first space formed by the two outer bosses; and means extending over one side of said pair of manifold plates for sealingly enclosing the adjacent intermediate channel of said manifold plates, said enclosing means having one or more apertures formed therein and forming a flow passage for said first fluid to flow between said openings in the intermediate channels and said one or more apertures, wherein said inner boss of one of said pair of manifold plates has holes for the passage of said second fluid into or out of a sealed second space formed by the two inner bosses.

22. A manifold according to claim 21 wherein said enclosing means is a third plate and said first and second fluids are heat exchanging fluids for carrying out heat exchange in a heat exchanger.

23. A manifold according to claim 22 wherein said third plate is a top ringlike plate having inner and outer peripheral flanges and a substantially annular, centrally located boss projecting upwardly from a plane defined by said outer peripheral flange of the third plate, said one or more apertures comprising a series of holes formed in a side wall of the centrally located boss.

24. A manifold according to claim 21 wherein said manifold is adapted to form a seat to support one end of an oil filter housing.

25. A manifold according to claim 22 wherein said inner and outer bosses each have a portion thereof located in a common second plane spaced from and parallel to said first plane.

26. A manifold according to claim 21 wherein the intermediate channels each have a portion thereof located in said first plane and the inner peripheral flanges of said pair of manifold plates are also located in said first plane.

27. A manifold according to claim 21 including an annular oil seal mountable on top of said enclosing means and adapted to seal a joint between said enclosing means and an oil filter housing mounted on top of said enclosing means during use of said manifold.

28. The combination of a heat exchanger and a manifold according to claim 22 wherein said heat exchanger includes a top plate having a central hole for passage of an elongate tube, said tube being provided for transfer of said first heat exchange fluid comprising oil and a first series and a second series of additional holes distributed around said central hole, said first series of holes being aligned in a radial direction with an adjacent one of the intermediate channels and said second series of holes being aligned with said holes in said inner boss for the passage of the second heat exchange fluid.

29. The combination of claim 28 wherein said manifold is mounted on said top plate of the heat exchanger and said third plate is adapted for mounting an oil filter on top thereof.

30. A heat exchanger for heat transfer between first and second heat exchanging fluids, said heat exchanger comprising:

a plurality of stacked plate pairs consisting of face-to-face, mating plates, each plate having edge flanges extending along edges thereof, first and second spaced-apart elongate primary ridges each having a portion thereof located in a common first plane with at least one of said edge flanges, an elongate secondary ridge having a portion thereof located in a second plane spaced from said first plane and substantially parallel thereto, said secondary ridge being provided between an adjacent one of said edge flanges and said first primary ridge of the respective plate, and an intermediate area located between said first and second primary ridges, the intermediate areas of each plate pair having spaced-apart portions to form an inner flow passage between the plates;

both said primary ridges and said secondary ridge having openings formed therein for the passage of said first and second heat exchanging fluids respectively;

said secondary ridges being arranged such that in back-to-back plate pairs, the secondary ridges are joined and the respective openings therein communicate to define a manifold for the flow of said second heat exchanging fluid;

the intermediate areas of back-to-back plate pairs having spaced-apart portions defining outer flow passages therebetween, wherein the primary ridges of at least one plate of each plate pair include ribs extending across the width of at least one primary ridge of the at least one plate and distributed along the length of the primary ridge, said ribs being located between and separated from said openings formed in the primary ridge and forming cross-over passages so that the cross over passages of each plate pair permit said secondary heat exchanging fluid to flow transversely across its respective primary ridges and through its respective inner flow passage.

31. A heat exchanger according to claim 30 further comprising flow augmentation means located in one of the inner flow passages and outer flow passages.

32. A heat exchanger according to claim 31 wherein said flow augmentation means comprises a turbulizer located in at least one of the inner and outer flow passages.

33. A heat exchanger according to claim 30 further comprising flow augmentation means located in both the inner flow passages and the outer flow passages.

34. A heat exchanger according to claim 33 wherein the flow augmentation means comprises a plurality of alternating ribs and grooves formed in said intermediate area between the respective first and second primary ridges, said ribs and grooves being angularly disposed so that the ribs and grooves in the mating plates cross forming an undulating inner flow passage between the pair of plates, and the ribs and grooves in adjacent back-to-back plate pairs cross forming undulating outer flow passages between plate pairs.

35. A heat exchanger according to claim 32 wherein said flow augmentation means comprises turbulizers located in both the inner and outer flow passages.

36. A heat exchanger according to claim 32 wherein said flow augmentation means comprises a plurality of spaced-apart dimples extending into at least one of the inner flow passages and the outer flow passages.

37. A heat exchanger according to claim 32 wherein said flow augmentation means comprises a plurality of dimples extending into both the inner flow passages and the outer flow passages.

38. A heat exchanger according to claim 30 wherein each plate has another elongate secondary ridge having a portion thereof located in said second plane and arranged on one side of said primary ridges which is furthest from the first mentioned secondary ridge, the another secondary ridges also having openings formed therein for the passage of said second heat exchanging fluid and being joined together so that their openings communicate to define a second manifold for the flow of the second heat exchanging fluid.

39. A heat exchanger according to claim 30 including at least one closure plate enclosing at least one of said primary and secondary ridges at one end of the stack of plate pairs, said at least one closure plate including at least one flow port for the flow of at least one of said first and second heat exchanging fluids therethrough.

40. A heat exchanger according to claim 30 including top and bottom closure plates each enclosing at least one of said primary and secondary ridges at its respective end of the stack of plates, each closure plate including at least one flow port for the flow of at least one of said first and second heat exchanging fluids.

41. A heat exchanger according to claim 30 including an edge manifold extending over and mounted on one side of said heat exchanger, said one side being the side thereof furthest from the secondary ridges of the plates, said edge manifold forming a substantial fluid distribution chamber for passage of said secondary heat exchanging fluid into or out of the inner flow passages.

42. A heat exchanger according to claim 41 wherein said edge manifold has a generally semi-cylindrical wall, is gradually tapered from one end thereof to an opposite end thereof, and is adapted to distribute said secondary heat exchanging fluid into said inner flow passages through slots formed in said one side of said heat exchanger.

43. A heat exchanger according to claim 30 wherein the primary ridges of each plate in the stack of plate pairs includes ribs extending across the width of their respective primary ridges and distributed along the length thereof.

44. A heat exchanger for heat transfer between first and second heat exchanging fluids, said heat exchanger comprising:

a plurality of stacked plate pairs consisting of face-to-face mating plates, each plate having edge flanges extending along edges thereof, first and second pairs of spaced-apart elongate primary ridges each having at least a portion thereof located in a common first plane with said edge flanges, three spaced-apart elongate secondary ridges each having a portion thereof located in a second plane spaced from said first plane and substantially parallel thereto, said secondary ridges including a central ridge and two outer ridges located on opposite sides of said central ridge and spaced therefrom, each outer ridge being separated from the central ridge by one of said pairs of primary ridges and an intermediate area located between the respective pair of primary ridges, the intermediate areas of each plate pair having spaced-apart portions forming inner flow passages between the plates of the pair;

both said primary ridges and said secondary ridges having openings formed therein for the passage of said first and second heat exchanging fluids respectively;

said secondary ridges being arranged such that in back-to-back plate pairs, the secondary ridges are joined and the respective openings thereof communicate to define three separate manifolds for the flow of said second heat exchanging fluid;

the intermediate areas of back-to-back plate pairs having space-apart portions defining outer flow passages therebetween, wherein the primary ridges of at least one plate of each plate pair include ribs extending across the width of at least two primary ridges of the at least one plate and distributed along the length of the at least two primary ridges, said ribs being located between and separated from said openings in the respective primary ridges and forming crossover passages so that the cross over passages of each plate pair permit said secondary heat exchanging fluid to flow transversely across its respective pairs of primary ridges and through its respective inner flow passages.

45. A heat exchanger according to claim 44 further comprising flow augmentation means located in both the inner flow passages and the outer flow passages.

46. A heat exchanger according to claim 45 wherein said flow augmentation means comprises a plurality of alternating ribs and grooves formed in said intermediate areas located between the pairs of primary ridges, said ribs and grooves being angularly disposed so that the ribs and grooves in the mating plates cross forming undulating inner flow passages between the pair of plates, and the ribs and grooves in adjacent back-to-back plate pairs cross forming undulating outer flow passages between plate pairs.

47. A heat exchanger according to claim 45 wherein said flow augmentation means comprises turbulizers located in both the inner flow passages and the outer flow passages.

48. A heat exchanger according to claim 45 wherein said flow augmentation means comprises a plurality of dimples extending into both the inner flow passages and the outer flow passages.

* * * * *

UNITED STATES PATENT AND TRADEMARK OFFICE

CERTIFICATE OF CORRECTION

PATENT NO. : 6,497,274 B2
DATED : December 24, 2002
INVENTOR(S) : Cheadle

It is certified that error appears in the above-identified patent and that said Letters Patent is hereby corrected as shown below:

Column 20,
Line 32, please delete "1" and insert -- 11 --.

Column 23,
Lines 22 and 26, please delete "32" and insert -- 33 --.

Signed and Sealed this

Twenty-second Day of July, 2003

JAMES E. ROGAN
*Director of the United States Patent and Trademark Office*